US010787336B2

(12) United States Patent
Tanjo

(10) Patent No.: US 10,787,336 B2
(45) Date of Patent: Sep. 29, 2020

(54) STACKER AND PROCESSING APPARATUS

(71) Applicant: SEIKO EPSON CORPORATION, Tokyo (JP)

(72) Inventor: Toru Tanjo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/115,626

(22) Filed: Aug. 29, 2018

(65) Prior Publication Data

US 2019/0062096 A1 Feb. 28, 2019

(30) Foreign Application Priority Data

Aug. 31, 2017 (JP) ..... 2017-167358

(51) Int. Cl.
*B65H 31/06* (2006.01)
*B65H 29/14* (2006.01)
(Continued)

(52) U.S. Cl.
CPC ..... *B65H 31/06* (2013.01); *B65H 29/14* (2013.01); *B65H 31/14* (2013.01); *B65H 31/22* (2013.01); *B65H 2301/42144* (2013.01); *B65H 2701/1914* (2013.01); *B65H 2701/1916* (2013.01); *B65H 2801/06* (2013.01)

(58) Field of Classification Search
CPC ..... B65H 31/06; B65H 31/14; B65H 2301/42144
See application file for complete search history.

(56) References Cited

U.S. PATENT DOCUMENTS 3,659,841 A * 5/1972 Rigotti ..... B65H 29/22 271/219
4,065,123 A * 12/1977 Arrasmith ..... B65H 31/06 271/178
(Continued)

FOREIGN PATENT DOCUMENTS

JP 61-055061 A 3/1986
JP 02-215647 A 8/1990
(Continued)

OTHER PUBLICATIONS

The Extended European Search Report for the corresponding European Patent Application No. 18191631.3 dated Feb. 1, 2019.

*Primary Examiner* — Howard J Sanders
(74) *Attorney, Agent, or Firm* — Global IP Counselors, LLP

(57) ABSTRACT

A stacker of the disclosure is disposed at an ejection opening of a processing apparatus. A support member of the stacker is movable toward an upstream side and a downstream side in an ejecting direction, receives each of the media ejected through the ejection opening, and supports the medium in such an orientation that the medium is inclined with an end edge of the medium on the downstream side in the ejecting direction positioned above an end edge of the medium on the upstream side in the ejecting direction and that the end edge of the medium on the upstream side in the ejecting direction abuts the stacking surface. A receding mechanism of the stacker causes the support member to recede toward the downstream side. A position maintaining mechanism of the stacker maintains a position of the support member having been moved by the receding mechanism.

18 Claims, 25 Drawing Sheets

(51) Int. Cl.
*B65H 31/14* (2006.01)
*B65H 31/22* (2006.01)

(56) References Cited

U.S. PATENT DOCUMENTS 5,137,415 A 8/1992 Doeberl et al.
5,295,680 A * 3/1994 Nishiguchi ..... B65H 29/18
271/185

FOREIGN PATENT DOCUMENTS

JP 05-330716 A 12/1993
JP 07-267468 A 10/1995
JP 07-323957 A 12/1995
JP 10-194553 A 7/1998
JP 11-199112 A 7/1999
JP 11-199113 A 7/1999

* cited by examiner

STACKER AND PROCESSING APPARATUS

INCORPORATION BY REFERENCE

The entire disclosure of Japanese Patent Application No. 2017-167358, filed Aug. 31, 2017 is expressly incorporated by reference herein.

BACKGROUND

1. Technical Field

The present disclosure relates to a stacker and a processing apparatus. The stacker is disposed at an ejection opening of the processing apparatus and causes media to be ejected through the ejection opening to be stacked and placed.

2. Related Art

Examples of such a stacker include those of, for example, JP-A-11-199113 and JP-A-10-194553. These documents describe a structure that includes a support member with which sheets ejected through an ejection opening of a printer are inclined upward and stacked. Here, the support member is positioned, instead of being positioned close to the ejection opening, so as to be largely separated from the ejection opening of the printer. The position of the support member is fixed. A conveyor belt is disposed between the ejection opening of the printer and the support member. The conveyor belt is downwardly inclined toward the downstream side in a feeding direction. The sheets are substantially horizontally ejected onto the conveyor belt, transported by the conveyor belt to the position of the support member, and stacked so as to be upwardly inclined.

In the above-described related-art stackers, the support member is fixed at the position largely separated from the ejection opening of a processing apparatus such as a printer instead of being positioned close to the ejection opening of the processing apparatus. This allows a larger amount of media to be stacked. However, since the position of the support member is fixed, the conveyor is necessary for transportation of the media to the separated position of the support member. Thus, there arises a problem in that the entirety of the stacker is increased in size. Furthermore, transportation by the conveyor belt is added. This arises a problem in that control of transport operation for stacking becomes complex.

SUMMARY

An advantage of some aspects of the disclosure is that an increase in size of a stacker can be suppressed while the amount of media to be stacked can be increased.

In order to obtain the above-described advantage, a stacker according to a first aspect of the disclosure is disposed at an ejection opening of a processing apparatus and causes media ejected through the ejection opening to be stacked and placed on a stacking surface. The stacker includes a support member, a receding mechanism, and a position maintaining mechanism. The support member is movable toward an upstream side and a downstream side in an ejecting direction, receives each of the media ejected through the ejection opening, and supports the medium in such an orientation that the medium is inclined with an end edge of the medium on the downstream side in the ejecting direction positioned above an end edge of the medium on the upstream side in the ejecting direction and that the end edge of the medium on the upstream side in the ejecting direction abuts the stacking surface. The receding mechanism causes the support member to recede toward the downstream side. The position maintaining mechanism maintains a position of the support member having been moved by the receding mechanism.

According to the first aspect, the support member that supports the media in an upwardly inclined orientation, that is, in a standing orientation is movable toward the upstream side and the downstream side in the ejection direction. Furthermore, the receding mechanism can cause the support member to recede toward the downstream side, and the position maintaining mechanism can maintain the position of the support member having receded by the specified distance, that is the position maintaining mechanism can hold the support member at this position. Thus, when the medium is supported by the support member so as to be in the standing orientation, the support member recedes by the specified distance and is kept at the position to which the support member has receded. This can ensure a space to support the next medium.

Accordingly, when 1. the receding of the support member by the specified distance,
2. operation to support the medium in the standing orientation at the support space for the medium ensured by the receding, and
3. the next receding are sequentially repeatedly performed, the increase in size of the stacker can be suppressed while the amount of media to be stacked can be increased.

Here, the term "maintain the position of the support member" means that the support member is held at the position to which the support member has been moved by the receding mechanism. However, this does not necessarily mean that the support member does not move at all. The position of the support member may move at low speed as long as a technical significance of the above-described term "maintain the position" (a state in which operation for supporting the next medium in the standing orientation can be performed at the support space for the media obtained by the receding) is substantially satisfied.

It is preferable that the position maintaining mechanism include a pulling mechanism that applies to the support member a pulling force to pull toward the upstream side and a suppressing mechanism that suppresses the pulling force at a position to which the support member has been caused to recede by a specified distance by the receding mechanism.

Here, the term "suppresses the pulling force" means canceling of the pulling force so as to maintain the support member at the position or reduction of the pulling force.

Thus, the position maintaining mechanism that maintains the position of the support member having been moved by the receding mechanism can be realized with a simple structure.

It is preferable that, in order to recede the support member, the receding mechanism apply a moving force to move against a frictional force caused by frictional resistance with the stacking surface which serves as a surface sliding against the support member. In this case, the position maintaining mechanism maintains the position of the support member by utilizing the frictional resistance.

Thus, the position of the support member having been moved by the receding mechanism is maintained at the position by utilizing the frictional force of the sliding surface. Accordingly, the position maintaining mechanism can be realized with a simple structure in which the constant force spring or the like is not used.

It is preferable that stacker further include a transport roller that receives the medium ejected through the ejection opening and that transports the medium toward the downstream side. In this case, the transport roller is driven by transmitting motive power with which the processing apparatus ejects the medium.

Thus, the stacker includes the transport roller that transports toward the downstream side the medium ejected through the ejection opening. By setting the transport roller as a base point of a medium transport path of the stacker, the design of the medium transport path and transport control can be simply performed.

Furthermore, the transport roller is driven by utilizing the motive power of the processing apparatus for the ejection. Accordingly, no dedicated motive power source is required.

It is preferable that the transport roller be driven by transmitting the motive power from a rotation shaft of an ejection roller positioned at a most downstream portion of the processing apparatus in the ejecting direction.

Thus, the motive power is transmitted to the transport roller from the rotation shaft of the ejection roller positioned at the most downstream portion near the ejection opening on the processing apparatus side. This allows the motive power transmission structure to be realized with a simple structure.

It is preferable that the receding mechanism include an advancing/retreating member provided on a rotation shaft of the transport roller. In this case, the advancing/retreating member repeatedly performs, linked with the rotation of the rotation shaft of the transport roller, pushing of the support member and retreating from the support member.

Thus, the advancing/retreating member provided on the rotation shaft of the transport roller repeatedly performs, linked with the rotation of the rotation shaft of the transport roller, pushing of the support member and retreating from the support member. This allows the receding mechanism to be realized with a simple structure. Furthermore, the receding of the support member by the specified distance can be performed by the "pushing" with the advancing/retreating member, and the operation to ensure the support space for the medium through the receding of the support member can be performed by the "retreating".

It is preferable that the receding mechanism include a first cam member provided on the rotation shaft of the transport roller. In this case, the first cam member causes, linked with the rotation of the rotation shaft of the transport roller, the advancing/retreating member to perform the pushing and the retreating.

Thus, the pushing and the retreating by the advancing/retreating member can be realized with a simple structure by using the first cam member provided on the rotation shaft of the transport roller.

It is preferable that the stacker further include a nipping member that, together with the transport roller, nips the medium therebetween so as to transmit a transport force of the transport roller to the medium while the medium is being nipped. In this case, the nipping is released when the advancing/retreating member performs the pushing.

Thus, the nipping performed by the nipping member paired with the transport roller so as to transmit the transport force to the medium is released while the advancing/retreating member is performing the pushing. Thus, the transport force is not transmitted to the medium while the pushing is being performed. Accordingly, during the operation to ensure the support space for the medium through the receding, the medium is not fed into the support space by the "pushing" of the advancing/retreating member. This can reduce the likelihood of jamming or creasing of the medium.

It is preferable that the nipping member be able to be displaced between a position at which the nipping member together with the transport roller performs the nipping and a position at which the nipping is released, and a second cam member be provided on the rotation shaft of the transport roller. In this case, the second cam member causes, linked with the rotation of the rotation shaft of the transport roller, the nipping member to be displaced.

Thus, the second cam member provided on the rotation shaft of the transport roller causes the nipping member to be displaced between the position at which the nipping member performs the nipping and the position at which the nipping is released. Accordingly, the nipping can be released with a simple structure.

It is preferable that the pulling mechanism be a constant force spring, and the suppressing mechanism be a regulating portion that regulates rotation of the constant force spring in a direction in which the constant force spring is wound.

Thus, the position maintaining mechanism can be easily realized with the constant force spring.

It is preferable that the stacker be a unitized device that is removably mountable in the processing apparatus.

Thus, the stacker is the unitized device that is removably mountable in the processing apparatus. Accordingly, stacking with the stacker and stacking performed by the processing apparatus itself without the stacker can be switched.

In particular, when the transport roller is driven by transmitting the motive power from a rotation shaft of the ejection roller positioned at the most downstream portion of the processing apparatus in the ejecting direction as has been described, the motive power on the processing apparatus side can be easily utilized with the structure in which the unitized stacker can be set in alignment with the ejection opening of the processing apparatus.

A processing apparatus according to a second aspect of the disclosure includes a processing unit, an ejection mechanism, and a stacker unit. The processing unit performs a specified process on media. The ejection mechanism ejects through an ejection opening the media transported thereto through the processing unit. The stacker unit receives the media ejected through the ejection opening and stacks the media. In this case, the stacker unit is any one form of the above-described stacker.

Thus, the processing apparatus can obtain the effects produced by any one form of the stacker.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

With a multi-functional ink jet printer that includes stacking-type medium cassettes, a medium feed tray for manual feeding, and a medium ejection tray for manual ejection as an example of a processing apparatus according to an embodiment of the disclosure, the structure of the processing apparatus according to the embodiment of the disclosure, the structure of a stacker according to the embodiment of the disclosure used for the medium ejection tray of the processing apparatus, and forms of operation of the processing apparatus mainly including operation of the stacker will be described in detail below with reference to the accompanying drawings.

Figure 1:
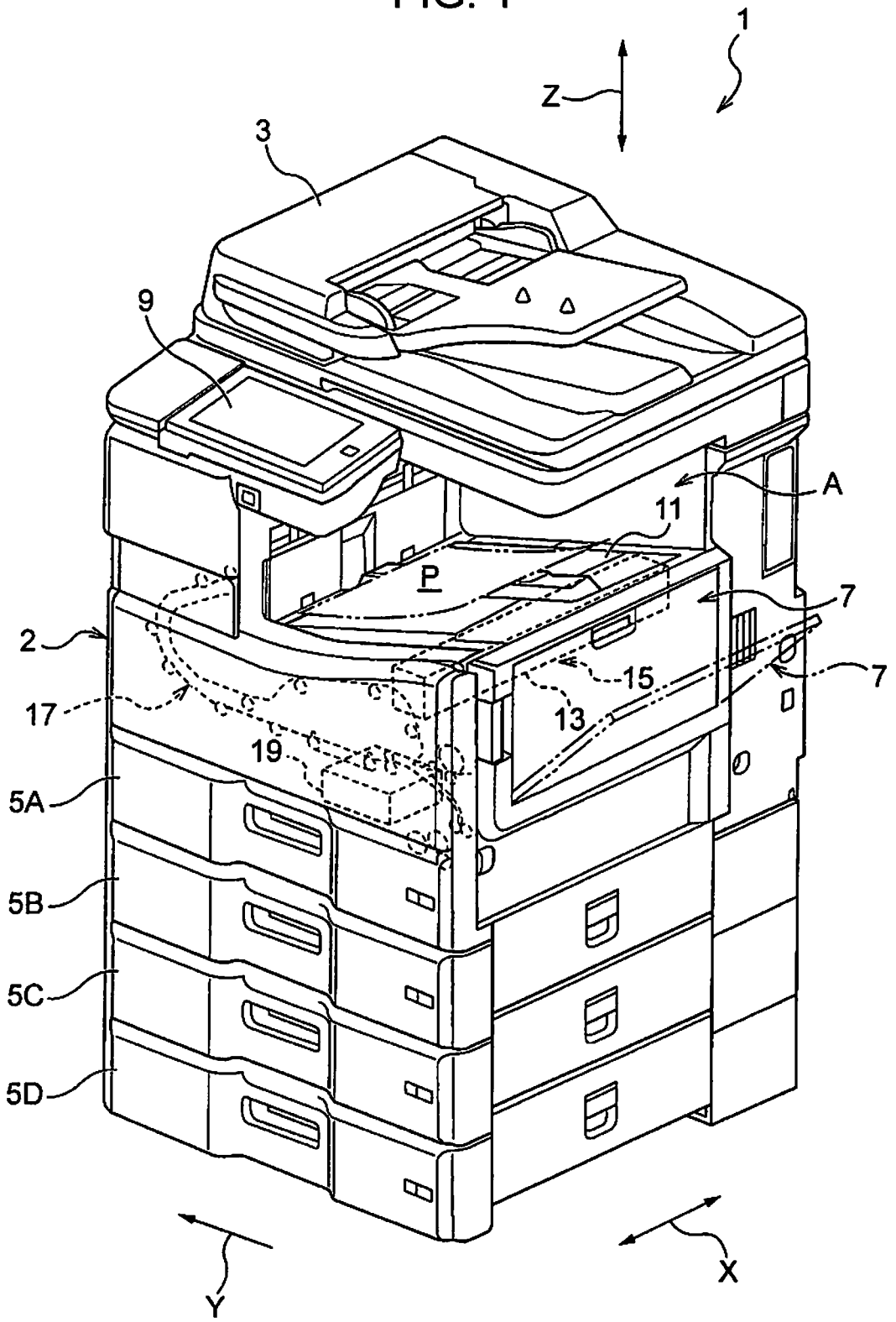
FIG. 1 is a perspective view of an example of a processing apparatus according to an embodiment of the disclosure seen from a diagonally front right side.
Figure 2:
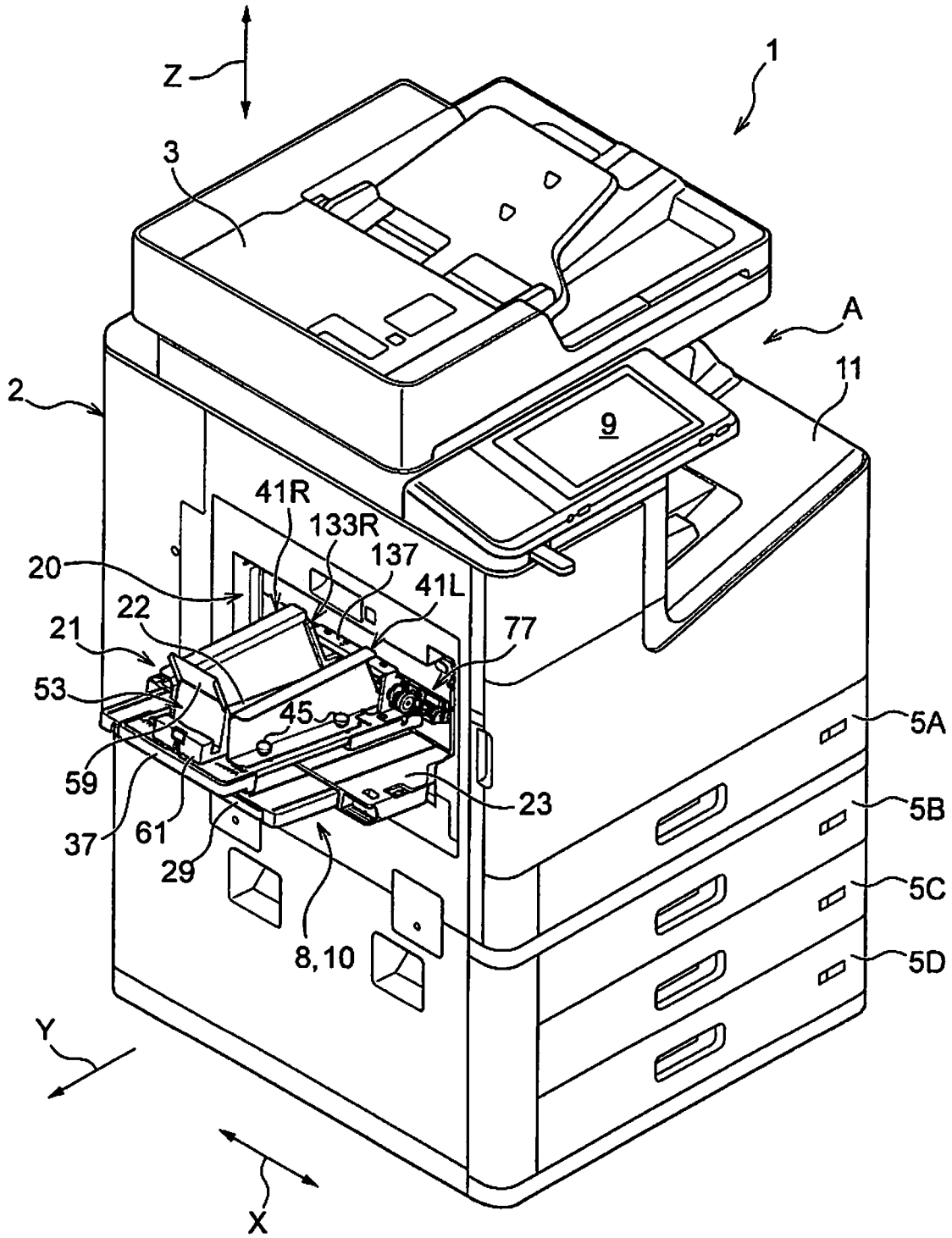
FIG. 2 is a perspective view of the example of the processing apparatus according to the embodiment seen from a diagonally front left side.
Figure 3:
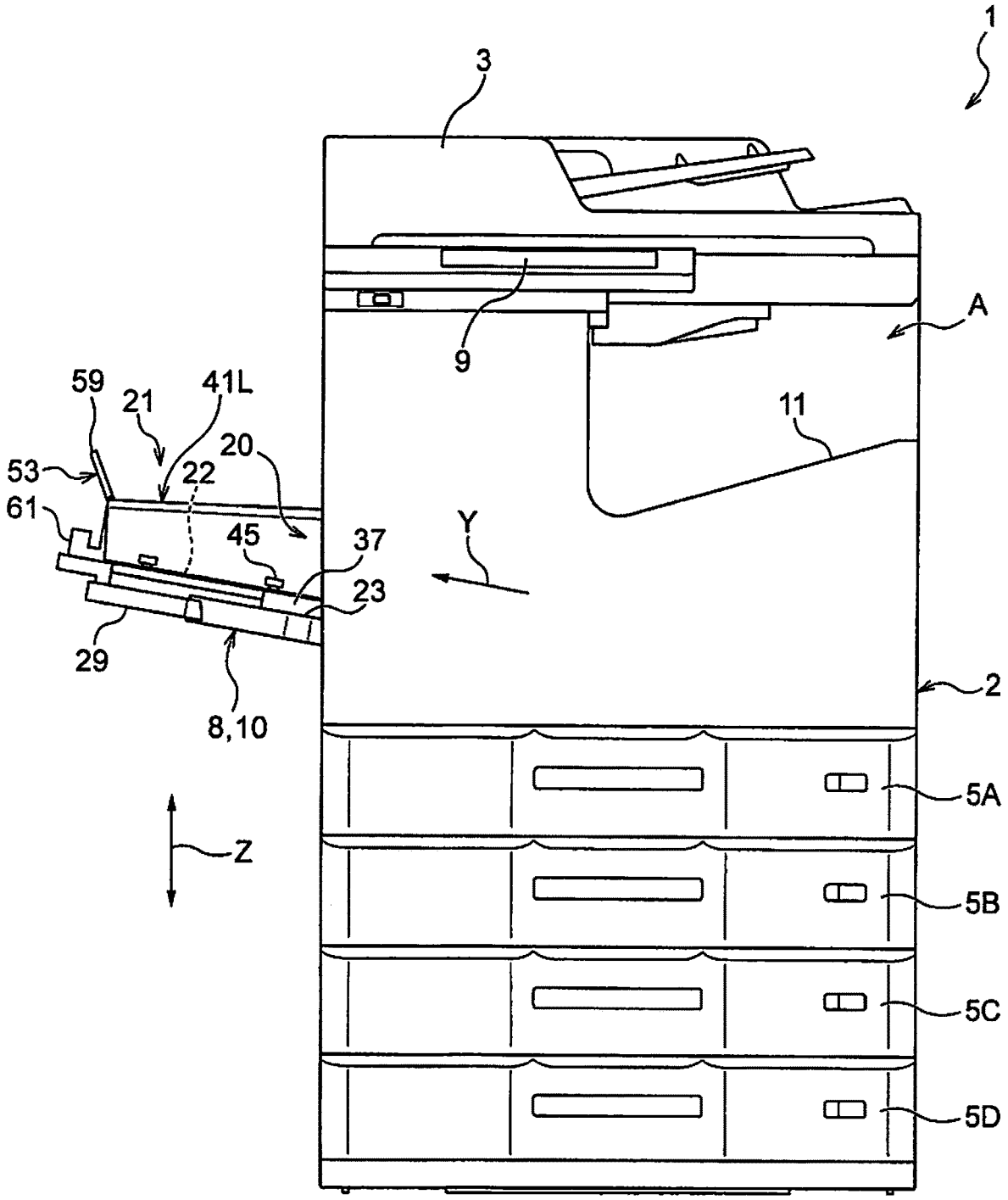
FIG. 3 is a front view of the example of the processing apparatus according to the embodiment.

In the following description, first, an outline of the overall structure of the processing apparatus according to the embodiment of the disclosure is described based on FIGS. 1 to 3. Next, the structure of an ejection unit is briefly described. The ejection unit includes the medium ejection tray for which the stacker according to the embodiment of the disclosure is used and members around the medium ejection tray. Next, the structure of the stacker according to the embodiment of the disclosure used for the medium ejection tray is specifically described. After that, the forms of operation of the processing apparatus according to the embodiment of the disclosure mainly including operation of the stacker are described. Finally, reference is made to the structures of other embodiments that are partially different from the structure of the embodiment are referred.

1. The Outline of the Overall Structure of the Processing Apparatus (with Reference to FIGS. 1 to 3)

A processing apparatus 1 illustrated in the drawings is a multi-functional ink jet printer that includes a scanner unit 3, medium cassettes 5A to 5D, a medium feed tray 7, and a medium ejection tray 8. The scanner unit 3 is disposed in an upper portion of an apparatus main body 2. For example, four medium cassettes 5A to 5D are disposed in a lower portion of the apparatus main body 2. The medium cassettes 5A to 5D are stacked one on top of another. The medium feed tray 7 is disposed in, for example, a right side surface of the apparatus main body 2. The medium feed tray 7 is used for manual feeding. The medium ejection tray 8 is disposed in, for example, a left side surface of the apparatus main body 2. The medium ejection tray 8 is used for manual ejection.

Furthermore, a display/operating panel 9 is provided, for example, on the left-hand side of an upper portion of the apparatus main body 2 as viewed from the front. The display/operating panel 9 is for setting various items and performing operations of the processing apparatus 1. A comparatively large space A is formed, for example, on the right-hand side of the display/operating panel 9 as viewed from the front. Media P which have been fed from the medium cassettes 5A to 5D and on which processes have been performed are received in the space A in a face placement orientation. The bottom of the space A is an ejection stacker 11.

Furthermore, a standard-equipment medium cassette 5A is provided uppermost in the stacked medium cassettes 5A to 5D in a lower portion of the apparatus main body 2. Three additional medium cassettes 5B to 5D are provided below the medium cassette 5A. Furthermore, the medium feed tray 7 of, for example, an opening/closing lid type for manual feeding is provided in, for example, the right side surface of the apparatus main body 2 as viewed from the front. Furthermore, the medium ejection tray 8 of, for example, an opening/closing lid type for manual ejection is provided in, for example, the left side surface of the apparatus main body 2 as viewed from the front.

Furthermore, the apparatus main body 2 includes therein a processing unit 13, a transport unit 17, an ejection unit 10, and a controller 19. The processing unit 13 performs specified printing processes by ejecting droplets of colors (for example, four colors including cyan (C), magenta (M), yellow (Y), and black (K)) to each of the media P having been fed from one of the medium cassettes 5A to 5D or the medium feed tray 7. The transport unit 17 transports the media P toward a processing region 15 of the processing unit 13. The ejection unit 10 ejects to the outside of the apparatus main body 2 the media P which have been fed from the medium feed tray 7 and on which processes have been performed. The controller 19 controls various operations of the processing unit 13, the transport unit 17, and the ejection unit 10, items displayed in the display/operating panel 9, and so forth by receiving information from the display/operating panel 9 and external devices such as a personal computer (PC) and the like.

As the processing unit 13, a so-called line-head-type processing head is provided. The line-head-type processing head performs a process (for example, recording) in a width direction X of each of the media P entirely at a time. This process is performed at a fixed feed pitch. The width direction X intersects a direction Y in which the media P are transported.

Of course, in the case where the quality of processing is considered as more important than the processing speed for the processing apparatus 1, a so-called serial-head-type processing head can be used. The serial-head-type processing head is mounted on a carriage (not illustrated) and is reciprocated in the width direction X so as to perform a specified process.

A transport unit into which is, for example, the following components are unitized is used as the transport unit 17: nipping transport rollers that transport toward the processing region 15 or the ejection unit 10, which will be described later, the media P having fed by feeding rollers (not illustrated); motors that drive these components; gear trains, belts, and so forth; guide rollers and guide plates that guide transportation of the media P; and a reverse mechanism that reverses the transport direction.

The processing apparatus 1 according to the present embodiment is basically a structured with the processing unit 13, an ejection mechanism 18 (FIG. 9), and a stacker 21 (stacker unit) included therein. The processing unit 13 performs specified processes on the media P. The ejection mechanism 18 ejects through an ejection opening 20 the media transported thereto through the processing unit 13. The stacker 21, which will be described later, receives media P ejected through the ejection opening 20 and stacks the received media P one on top of another.

Furthermore, according to the present embodiment, the unitized stacker 21 removably disposed in the ejection unit 10 of the processing apparatus 1 is used.

Herein, "face placement orientation", which may alternatively be referred to as "lying orientation", refers to an orientation in which the media P are stacked such that the faces of the media P are horizontally placed along a placement surface 23 of the medium ejection tray 8, and "edge placement orientation", which may alternatively be referred to as "standing orientation", refers to an orientation in which the media P are stacked such that the edges of a plurality of the media P are in contact with a stacking surface 22 of the stacker 21, which will be described later, that is, the media P stand erect.

Accordingly, compared to a method of using only with the medium ejection tray 8 on which media P are stacked in the face placement orientation (lying orientation), it is possible to significantly increase the number of the media P that can be stacked by using the stacker 21 that allows a large number of the media P to be stacked in the edge placement orientation (standing orientation).

2. The Structure of the Ejection Unit (with Reference to FIGS. 4, 5, and 9)

Figure 9:
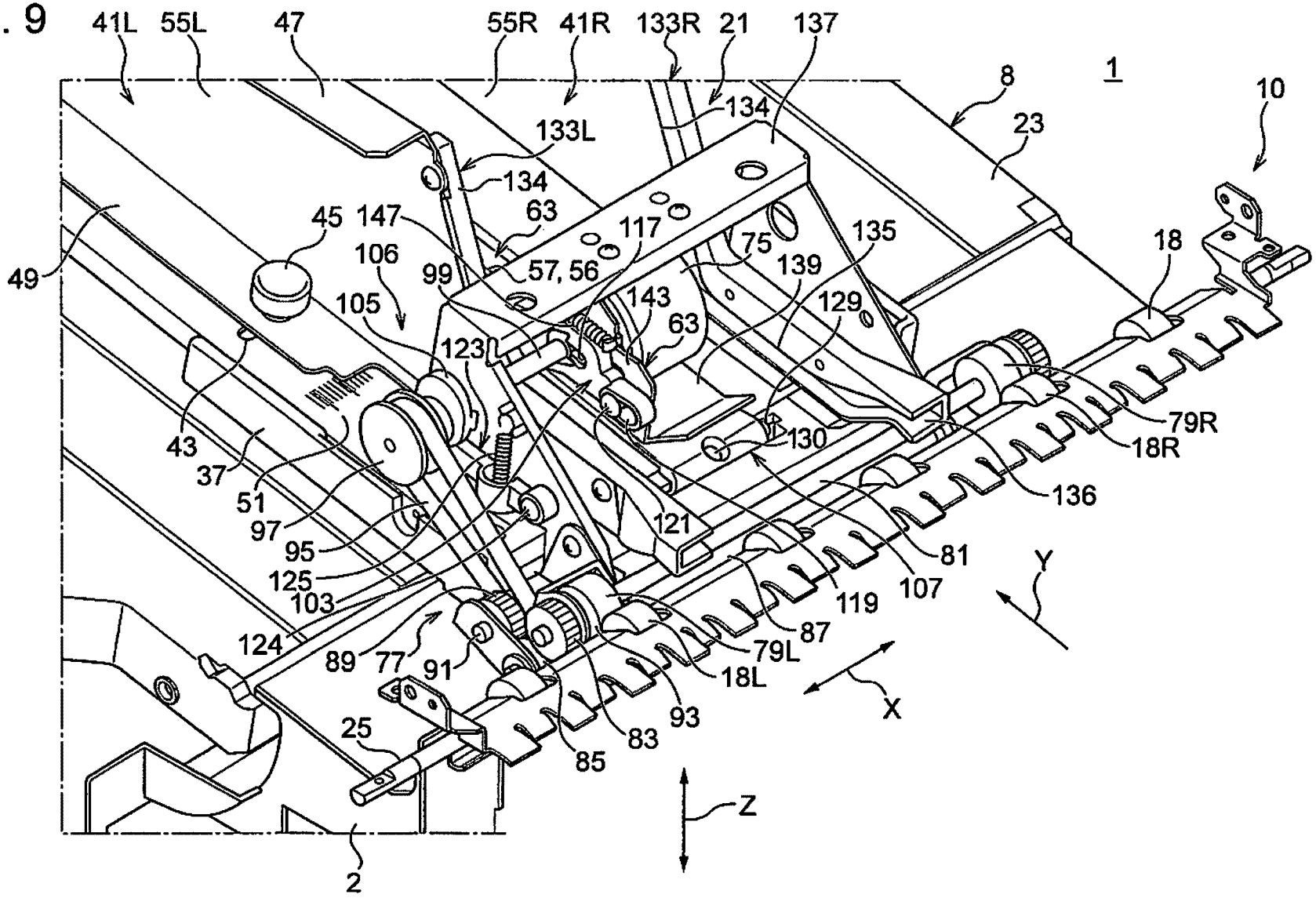
FIG. 9 is a perspective view of a power transmission unit of the stacker according to the embodiment.

For example, the ejection unit 10 includes the ejection opening 20, the medium ejection tray 8, and ejection rollers 18 (FIG. 9). The ejection opening 20 is formed in, for example, the left side surface of the apparatus main body 2. The medium ejection tray 8 openably closes the ejection opening 20. The ejection rollers 18 are provided on the apparatus main body 2 side so as to face the ejection opening 20 and serve as elements of the ejection mechanism.

Figure 15:
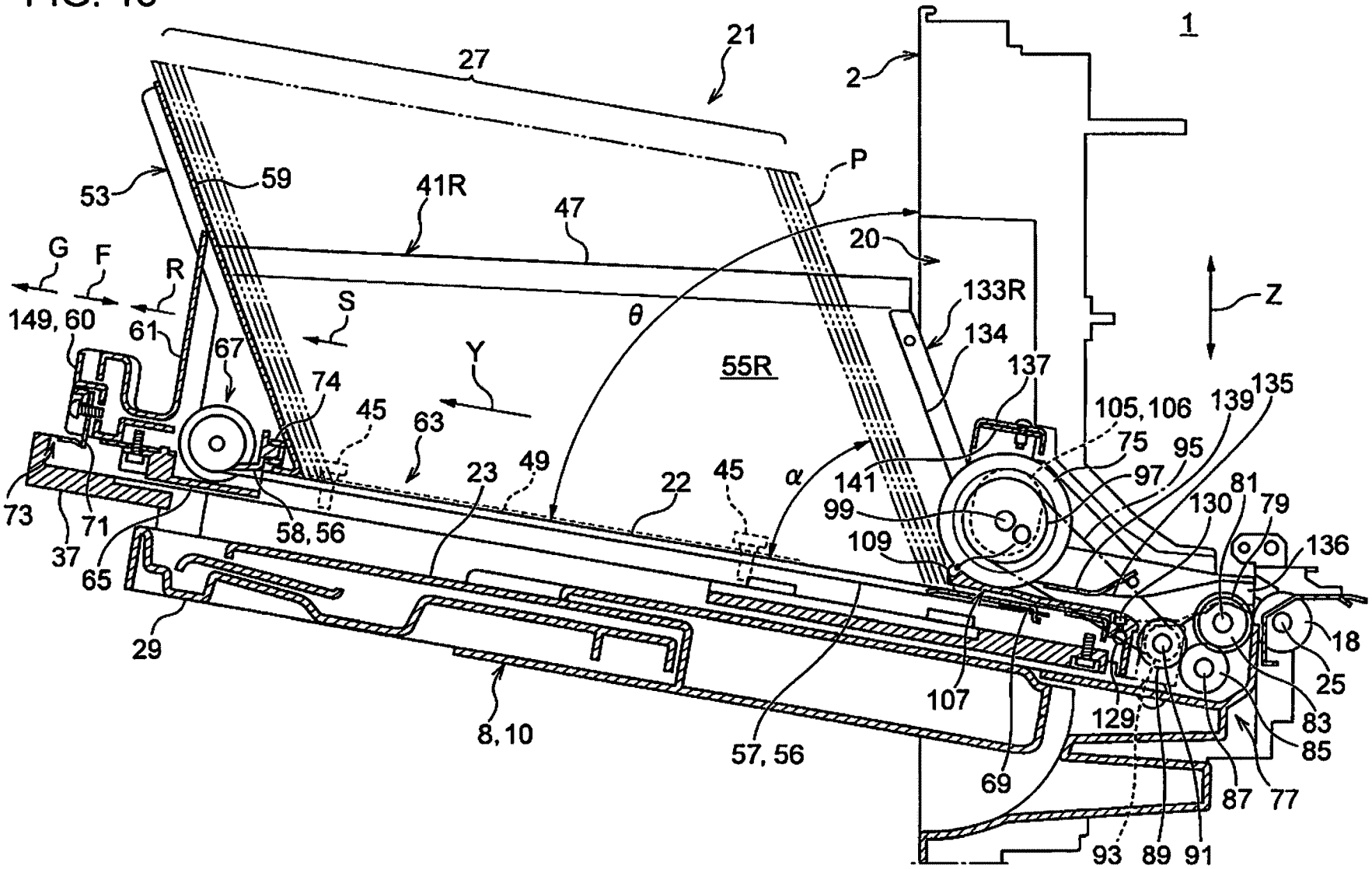
FIG. 15 is a side sectional view of the stacker according to the embodiment with the support member positioned at a maximum stack position.

The ejection opening 20 has a rectangular window shape elongated in the width direction X. The ejection opening 20 has a recessed space extending slightly inward from the side surface of the apparatus main body 2. The medium ejection tray 8 has pivot supports (not illustrated) disposed at lower portions of inner surfaces at both end portions in the width direction X in the recessed space. The medium ejection tray 8 is pivotable about the pivot supports between a position where the medium ejection tray 8 is in a closed state in which the medium ejection tray 8 closes the ejection opening 20 formed in the side surface of the apparatus main body 2 while being parallel to this side surfaces and a position where the medium ejection tray 8 is in an open state in which the medium ejection tray 8 is opened so as to expose the ejection opening 20 while the medium ejection tray 8 intersects this side surface at an angle θ (FIG. 15).

According to the illustrated embodiment, the angle θ at which the medium ejection tray 8 intersects the side surface is set to, for example, about 80°. Due to this setting, the placement surface 23 of the medium ejection tray 8 extending toward the downstream side in a direction Y in which the media P is ejected becomes an upward inclination of about 10°.

A handle (not illustrated) is provided in a front surface of the medium ejection tray 8. A user holds this handle to cause the medium ejection tray 8 to pivot. A rear surface of the medium ejection tray 8 is the placement surface 23 on which the media P is placed in the face placement orientation (lying orientation). An extension tray 29 is connected to the medium ejection tray 8 at a distal end portion of the medium ejection tray 8. The extension tray 29 can be drawn out in the direction Y in which the media P is ejected and retracted in the opposite direction. Although it is not illustrated, the placement surface 23 of the medium ejection tray 8 has, for example, a recess, and a base frame 37 of the stacker 21, which will be described later, has, for example, a projection at its bottom surface. With this structure, positioning in a planar direction XY parallel to the placement surface 23 is performed by fitting the projection into the recess.

As illustrated in FIG. 9, a plurality of (six according to the illustrated embodiment) the ejection rollers 18, which is, as examples, formed of rubber, are disposed on a shaft 25 horizontally extending in the width direction X such that the ejection rollers 18 are appropriately spaced from one another in the width direction X. Motive power is transmitted from, for example, the transport unit 17 in the apparatus main body 2 to the shaft 25 so as to rotate the shaft 25 in an ejection direction Y in which the medium P is ejected.

Furthermore, the stacker 21, which will be described next, is not particularly provided with a motive power source. The stacker 21 performs specified operations by receiving motive power from the ejection rollers 18 rotated together with the shaft 25.

3. The Structure of the Stacker (with Reference to FIGS. 6 to 11 and 13 to 16)

According to the present embodiment, the stacker 21 is provided at the ejection opening 20 of the processing apparatus 1 and stacks the media P ejected through the ejection opening 20. The media P are stacked in the direction Y in which the media P is ejected. The media P stacked are in the edge placement orientation (standing orientation).

The stacker 21 basically includes a support member 53, a receding mechanism 111, and a position maintaining mechanism 56. The support member 53 is movable toward the upstream side and the downstream side in the ejecting direction Y, receives the media P ejected through the ejection opening 20, and supports the media P such that the media P are inclined upward at an inclination angle α (FIG. 15). The receding mechanism 111 (FIGS. 7 to 12D) causes the support member 53 to recede toward the downstream side in the ejecting direction Y. The position maintaining mechanism 56 (FIGS. 6 and 9 to 14) that maintains the position of the support member 53 having been moved by the receding mechanism 111.

The Position Maintaining Mechanism

Figure 16:
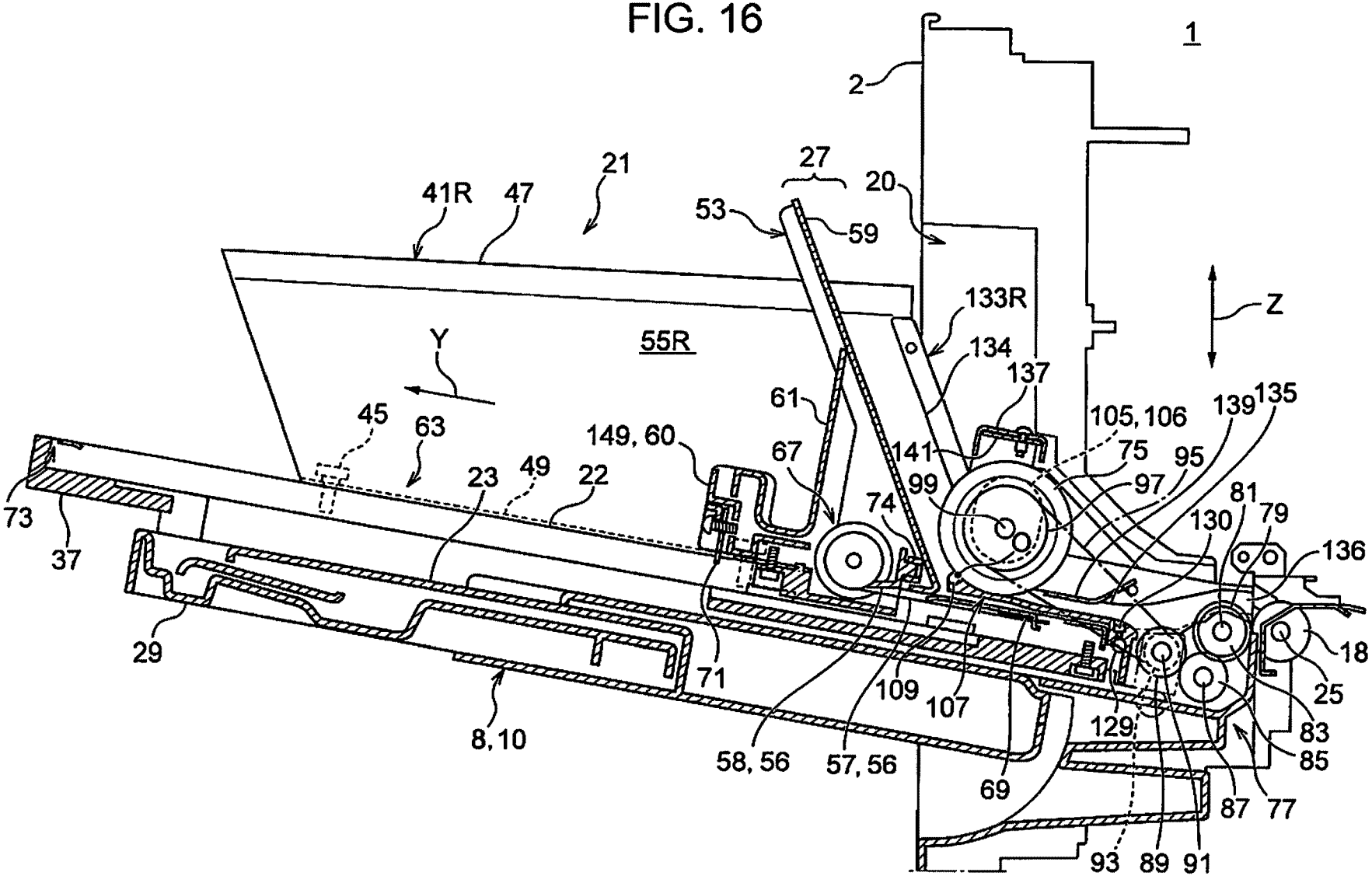
FIG. 16 is a side sectional view of the stacker according to the embodiment with the support member positioned at a stack start position.

As illustrated in FIGS. 13 to 16 and 18A to 18D, the position maintaining mechanism 56 includes a pulling mechanism 57 and a suppressing mechanism 58. The pulling mechanism 57 causes a force F (FIG. 15) that pulls toward the upstream side in the ejecting direction Y to act on the support member 53. The suppressing mechanism 58 (FIG. 14) suppresses the pulling force F at a position to which the support member 53 has caused to recede by the receding mechanism 111 by a specified distance S (FIGS. 12C, 15, and 17C).

Here, the term "suppresses the pulling force F" means both the following operations: maintaining the support member 53 at the position by causing a force the magnitude of which is the same as the pulling force F and which is oppositely directed to the pulling force F to act so as to cancel the pulling force F; and causing a force the magnitude of which is not the same as the pulling force F and which is oppositely directed to the pulling force F to act so as to reduce the pulling force F.

Figure 6:
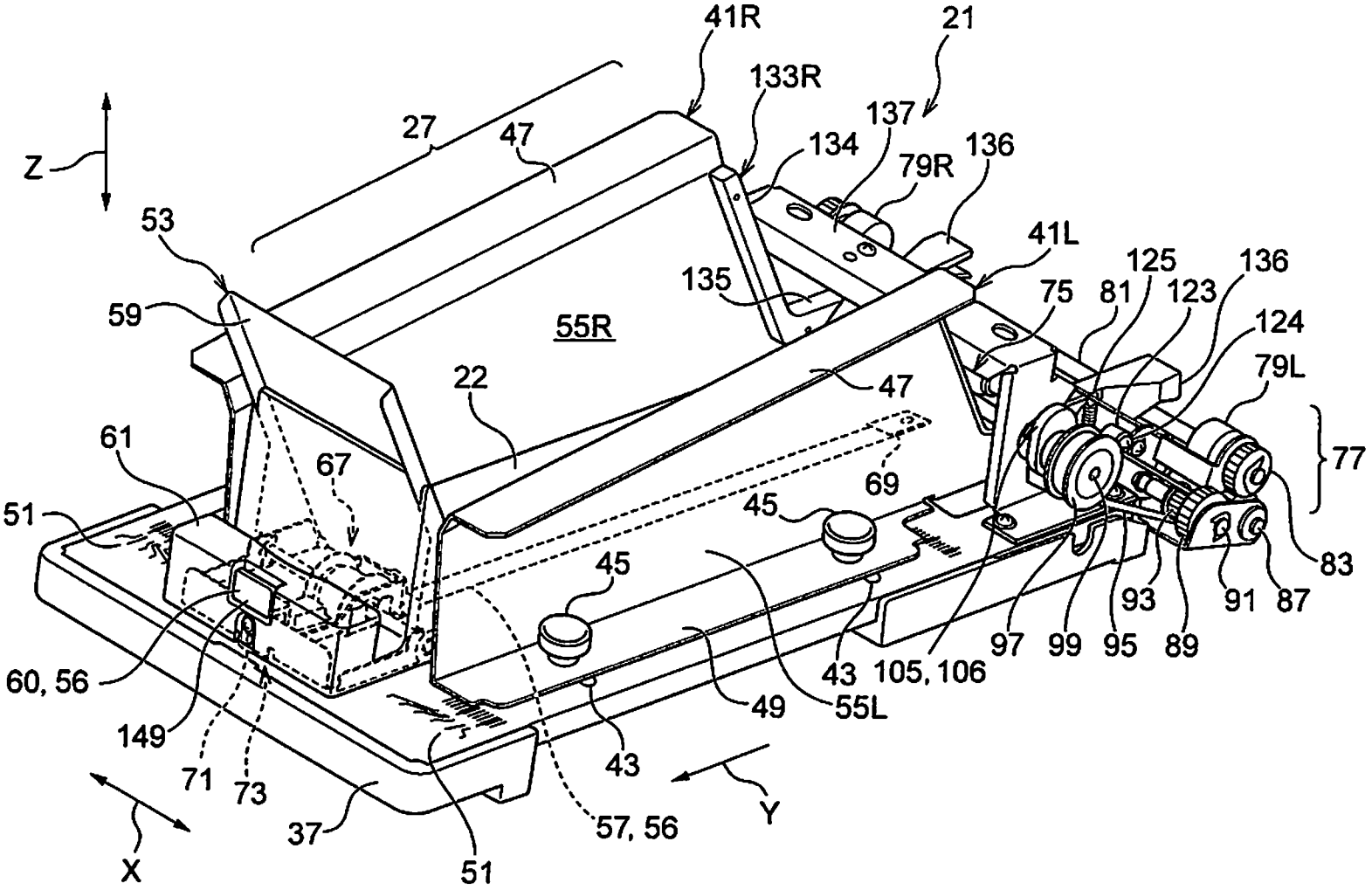
FIG. 6 is a perspective view of the stacker according to the embodiment seen from a diagonally rear left side.
Figure 7:
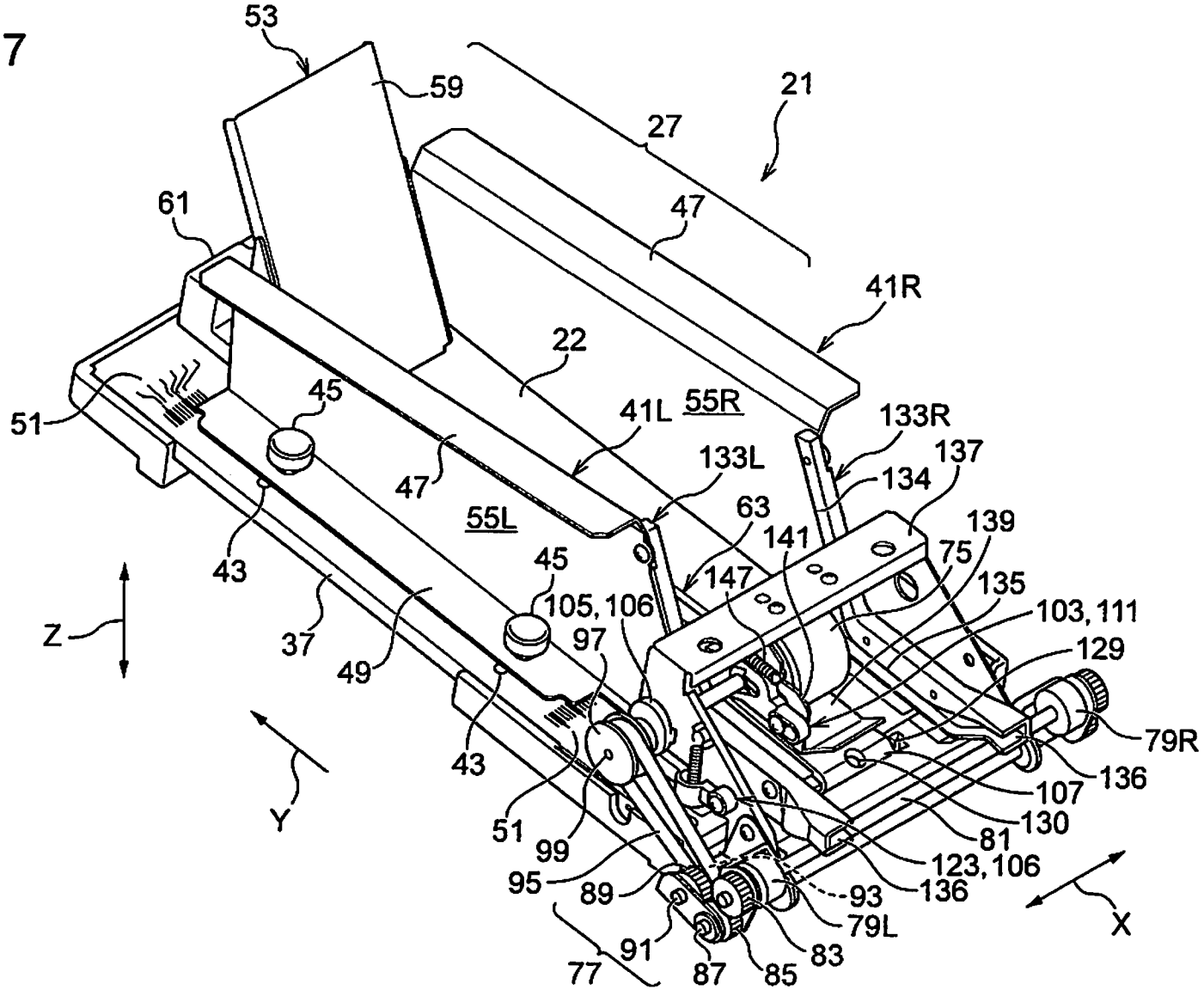
FIG. 7 is a perspective view of the stacker according to the embodiment seen from a diagonally front left side.

As illustrated in FIGS. 6 and 7, the stacker 21 includes the base frame 37 having a substantially rectangular plate shape. Various components to be described below are provided on an upper surface of the base frame 37.

First, a pair of side guide portions 41L and 41R (simply denoted as "41" in some cases) are provided near respective side end portions of the base frame 37 in the width direction X. The side guide portions 41L and 41R guide the respective side edges of the media P, the side edges located at the sides in the X direction. Here, the media P is to be stacked in the edge placement orientation (standing orientation). For example, the side guide portions 41L and 41R can be moved toward/separated from each other over a specified stroke in the width direction X. The distance between the left and right side guide portions 41L and 41R is adjusted within the length of elongated holes 43 formed as examples in the base frame 37. The side guide portions 41L and 41R are fixed at respective positions by tightening fixing screws 45 as examples having knobs at the heads thereof. Two fixing screws 45 are provided at each side in the width direction X, that is, a total of four fixing screws 45 are provided.

The side guide portions 41L and 41R are formed by, for example, bending thin metal sheets into a U shape. Upper bent portions that project outward serve as handle portions 47 to be held by hands for operation when adjusting the distance between the side guide portions 41L and 41R. Furthermore, lower bent portions serve as base plates 49 in contact with the upper surface of the base frame 37 so as to hold the side guide portions 41L and 41R in a standing position.

Furthermore, in the ejecting direction Y, the length of the side guide portions 41L and 41R is slightly smaller than the length of the base frame 37. A member of a transportation system, which will be described later, the receding mechanism 111 that cooperates with the transport system member, and elements of a nip release mechanism 106 (FIGS. 11 and 12A to 12D), which will be described later, are disposed in a space upstream of the side guide portions 41L and 41R in the ejecting direction Y. The transport system member reorients the ejected media P in the face placement orientation (lying orientation) so that the media P assume the edge placement orientation (standing orientation) and feed the media P to a stacking region 27 of the stacker 21.

Meanwhile, in a space downstream of the side guide portions 41L and 41R in the ejecting direction Y, a guide scale 51 (FIG. 6) and an accommodating space are formed. The guide scale 51 serves as a guide when the distance between the side guide portions 41L and 41R is adjusted. The accommodating space accommodates the support member 53 having moved to a maximum stacking position. The support member 53 will be described later.

In addition to the above-described guide scale 51, guide scales 51 are also formed beside upstream end portions of the side guide portions 41L and 41R in the ejecting direction Y. Spaces obtained by cutting parts of the base plates 49 are utilized for these guide scales 51.

Furthermore, the height of guide side plates 55 that connect the handle portions 47 and the base plates 49 of the side guide portions 41L and 41R to one another is large on the upstream side and small in the downstream side in the ejecting direction Y. That is, the side guide portions 41L and 41R are set such that the guiding distance is larger on the upstream side where the media P ejected from the processing apparatus 1 are placed on the stacker 21 than on the downstream side where media P are removed from the stacker 21.

This improves performance with which the media P are aligned in a region on the upstream side of the side guide portions 41L and 41R and improves performance with which the media P are removed in a region on the downstream side of the side guide portions 41L and 41R.

The support member 53 includes a support plate 59 and a slide block 61. The support plate 59 supports the media P in such an orientation that the media P are inclined toward the downstream side with upper portions thereof are further in the ejecting direction Y than lower portions thereof. The slide block 61 supports the support plate 59 such that the support plate 59 is movable toward the upstream side and the downstream side in the ejecting direction Y. According to the present embodiment, the support plate 59 is inclined at, for example, an inclination angle α (FIG. 15) of about 60° relative to the stacking surface 22 of the stacker 21. The stacking surface 22 is part of the upper surface of the base frame 37, the left and right sides of which are defined by the side guide portions 41L and 41R and the surface of which on the downstream side in the ejecting direction Y is defined by the support plate 59.

The slide block 61 includes a projection 65, a winding mechanism 67 (FIGS. 6, 13, and 14), a regulating portion 58, a regulation release lever 60 (FIGS. 6, 15, and 16), and so forth. The projection 65 (FIG. 15) is provided in a lower surface of the slide block 61 and engaged with a guide hole 63 (FIG. 7) extending in the ejecting direction Y at the center of the base frame 37 in the width direction X. The winding mechanism 67 (FIGS. 6, 13, and 14) is provided in the slide block 61 and for a constant force spring 57 (denoted by the same reference sign as that of the pulling mechanism) included in the pulling mechanism 57. The regulating portion 58 (FIG. 14) is included in the suppressing mechanism. The regulation release lever 60 (FIGS. 6, 15, and 16) is operated in order to release a stated regulated by the regulating portion 58.

The Transport System Member

Next, the transport system member is described. As has been described, the stacker 21 according to the present embodiment moves the media P to the stacking region 27 by driving the transport system member, which is described below, by using the rotation of the ejection rollers 18 of the processing apparatus 1 as a motive power source.

As the transport system member, a transport roller 75 (for example, FIG. 7) is provided. The transport roller 75 applies a feeding force to the media P ejected by the ejection rollers 18 to the outside of the apparatus main body 2. The transport roller 75 is attached to a rotation shaft 99 supported by a support frame 137 provided in a space on the upstream side of the base frame 37 in the ejecting direction Y. The transport roller 75 is located, for example, at the center in the stacker 21 in the width direction X.

Figure 10:
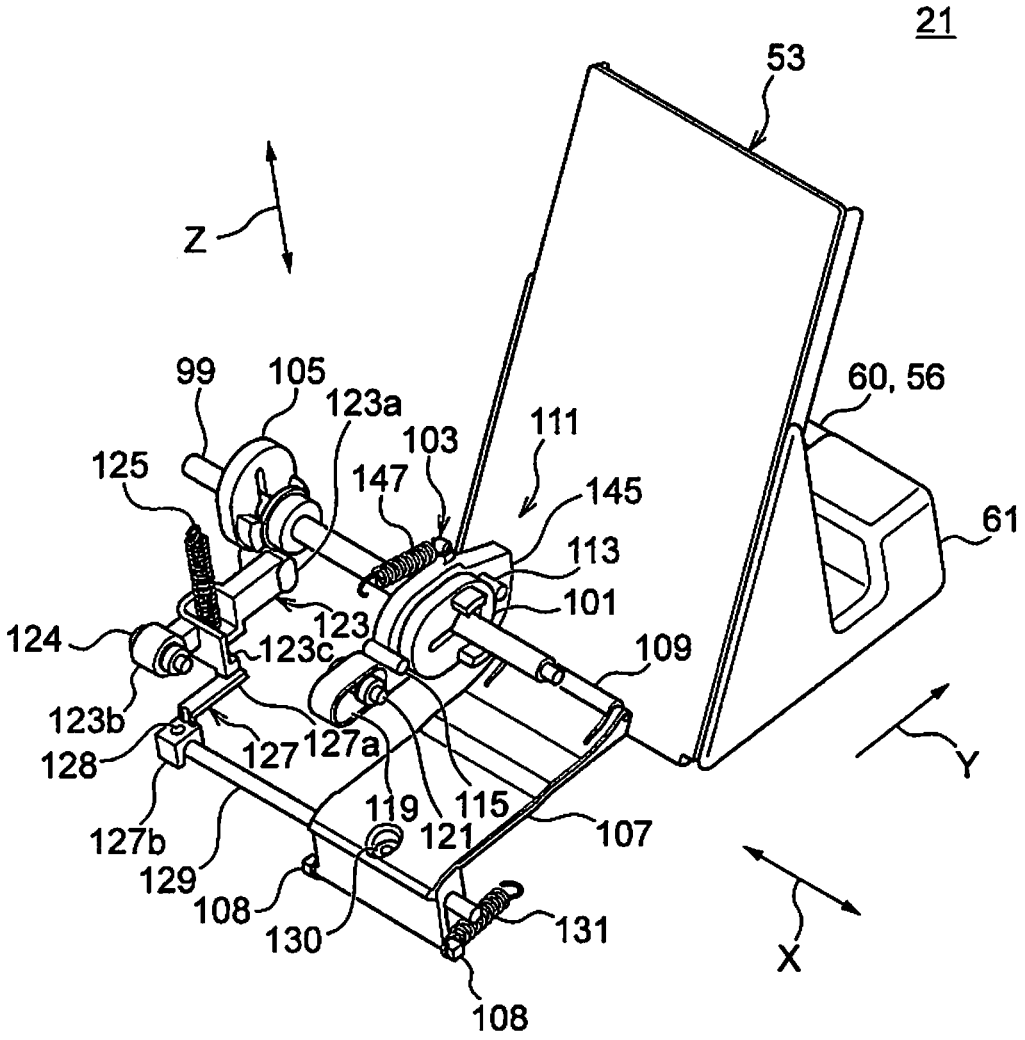
FIG. 10 is a perspective view of a receding mechanism and a position maintaining mechanism of the stacker according to the embodiment seen from a diagonally front right side.
Figure 11:
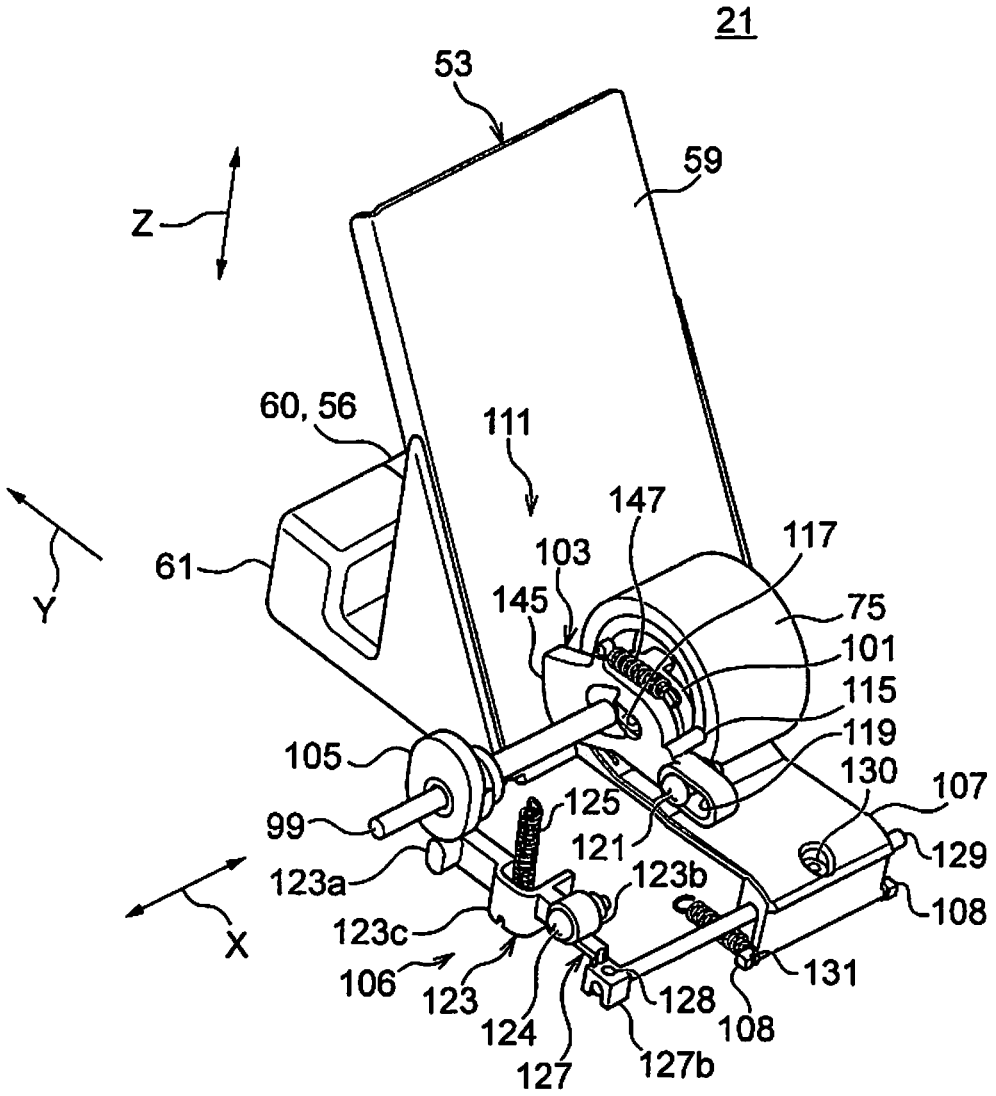
FIG. 11 is a perspective view of the receding mechanism and the position maintaining mechanism of the stacker according to the embodiment seen from a diagonally front left side.

The transport roller 75 paired with a nipping member 107 (for example, FIG. 8) provided below the transport roller 75 nips the supplied media P, thereby applying the feeding force to the media P. As illustrated in FIGS. 10 and 11, the nipping member 107 includes a plate-shaped member that substantially horizontally extends toward the downstream side in the ejecting direction Y from a bent portion where the nipping member 107 is bent downward. The bent portion is disposed at an end portion on the upstream side in the ejecting direction Y where a pivot shaft 129 is integrally fixed with a fixing screw 130.

For example, a nipping roller 109 (FIGS. 15 to 17D) is provided at an end portion of the nipping member 107 on the downstream side in the ejecting direction Y. This end portion is a pivot free end of the nipping member 107. The nipping roller 109 is brought into contact with the transport roller 75 for nipping operation.

Furthermore, retaining claws 108 are provided at a lower end of the downwardly bent portion on the upstream side of the nipping member 107. The retaining claws 108 outwardly project to the left and right in the width direction X. A spring 131 (FIGS. 10 to 12D) is attached to each of the retaining claws 108. The spring 131 performs pushing so that the pivot free end of the nipping member 107 is constantly displaced toward the transport roller 75.

The nipping roller 109 is a preferable structure for smooth transportation of the media P. However, the nipping roller 109 may be omitted when a sufficient feeding force can be obtained only by a contact of the transport roller 75 with the pivot free end of the nipping member 107.

A Power Transmission Unit

Next, based on FIGS. 6 to 9, the structure of a power transmission unit 77 is described. The power transmission unit 77 transmits the motive power of the ejection rollers 18 to the transport roller 75. Out of, for example, six of the ejection rollers 18 provided on the shaft 25, the power transmission unit 77 utilizes, for example, ejection rollers 18L and 18R (simply denoted as "18" in some cases) that are a second ejection roller 18 from the left end and a second ejection roller 18 from the right end in the width direction X, respectively, to transmit the motive power (FIG. 9).

Specifically, the power transmission unit 77 includes, for example, transmission rollers 79L and 79R, first transmission gears 83, intermediate gears 85, a second transmission gear 89, an input pulley 93, and an output pulley 97. The transmission rollers 79L and 79R (simply denoted as "79" in some cases) abut the ejection rollers 18L and 18R, thereby the rotation is first transmitted to the transmission rollers 79L and 79R. The first transmission gears 83 are provided on the shaft 81, on which the transmission rollers 79L and 79R are provided, and rotated together with the transmission rollers 79L and 79R. The intermediate gears 85 are engaged with the first transmission gears 83 and rotated about a shaft 87. The second transmission gear 89 is engaged with one of the intermediate gears 85. The input pulley 93 is provided on a shaft 91, on which the second transmission gear 89 is provided, and rotated together with the second transmission gear 89. The rotation of the input pulley 93 is transmitted via a toothed timing belt 95 to the output pulley 97 provided on the rotation shaft 99, on which the transport roller 75 is provided. Thus, the output pulley 97 is rotated together with the transport roller 75.

Furthermore, according to the present embodiment, the transport roller 75 is rotated in the opposite direction to the rotation direction of the ejection rollers 18 and rotated at the same speed as the rotation speed of the ejection rollers 18. Thus, the media P are smoothly moved and transported to the stacker 21.

Lifting-Off Suppressing Members

Next, based on FIGS. 6 to 9, lifting-off suppressing members 133L and 133R (simply denoted as "133" in some cases) are described. The lifting-off suppressing members 133L and 133R improve performance with which the media P is introduced by suppressing lifting-off of the media P caused by curl or the like of the media P occurring when the media P is moved to the stacker 21.

That is, end edges of the guide side plates 55L and 55R (simply denoted as "55" in some cases) of the side guide portions 41L and 41R on the upstream side in the ejecting direction Y are inclined at the substantially same angle as the angle at which the support plate 59 of the support member 53 is inclined. The lifting-off suppressing members 133L and 133R are provided inside the inclined end edges. Each of the lifting-off suppressing members 133L and 133R has a substantially L shape in side view.

The lifting-off suppressing members 133L and 133R include inclined portions 134 and horizontal portions 135. The inclined portions 134 are provided along the end edges of the guide side plates 55L and 55R of the side guide portions 41L and 41R on the upstream side in the ejecting direction Y. The horizontal portions 135 extend from the lower ends of the inclined portions 134 toward the upstream side in the ejecting direction Y so as to be continuous with the inclined portions 134 and parallel to the upper surface of the base frame 37. Furthermore, end portions of the horizontal portions 135 on the upstream side in the ejecting direction Y slightly outwardly projects to the left and right in the width direction X so as to have a large width. Thus, entrance guides 136 having, for example, a U-shaped section are provided of portions functioning as slopes that guide the media P ejected to the end portions by the ejection rollers 18 so that misalignment in the width direction X is corrected and the media P comes to the center in the width direction X.

Furthermore, gaps having specified sizes are formed between each of the side edges of the medium P in the width direction X moved to the stacker 21 and transported and a rear surface of a corresponding one of the inclined portions 134 and between these edge of the medium P and a lower surface of a corresponding one of the horizontal portions 135. Lifting-off and inclination of the medium P are regulated within the sizes of these gaps. Accordingly, even when a force that displaces an upper portion of the medium P having been transitioned to the edge placement orientation (standing orientation) toward the upstream side in the ejecting direction Y acts, the medium P is brought into contact with the rear surface of the inclined portion 134, and the medium P that is lifted off or inclined larger than the sizes of the above-described gaps is restored to the original position. Thus, smooth transportation of the media P on the stacking surface 22 is maintained.

Figure 8:
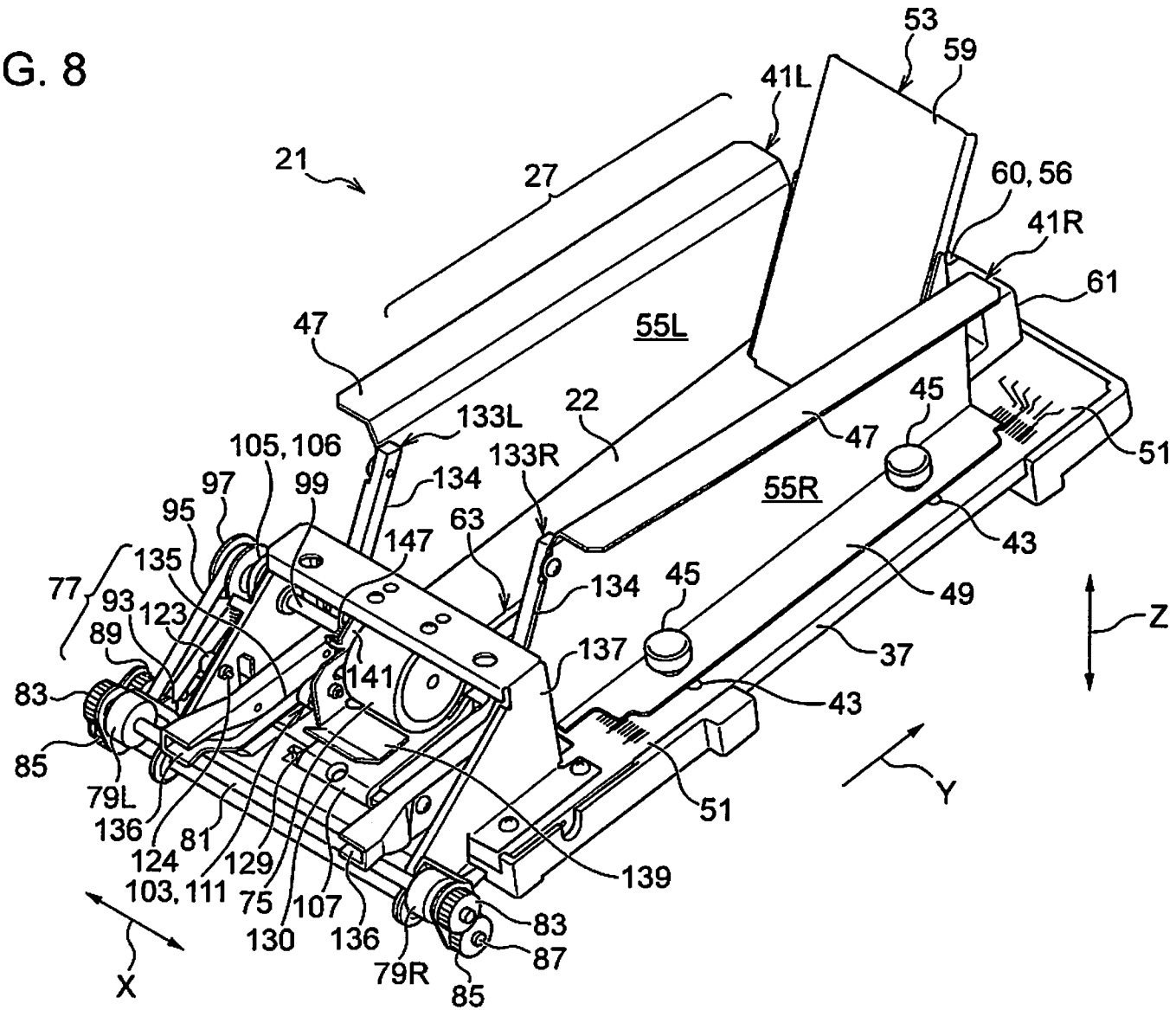
FIG. 8 is a perspective view of the stacker according to the embodiment seen from a diagonally front right side.

Furthermore, the support frame 137 has a sub-frame 141 at a top plate portion thereof. The sub-frame 141 extends downward and has a substantially L shape in section (FIGS. 8 and 9). The sub-frame 141 has a side wall portion 143 perpendicular to the upper surface of the base frame 37 and a bottom plate portion parallel to the upper surface of the base frame 37. The bottom plate portion serves as a suppressing plate 139 that suppresses lifting-off or bulging in the central portion of the medium P in the width direction X being moved to the stacker 21.

The position where the suppressing plate 139 is provided is set upstream of the transport roller 75 in the ejecting direction Y. An upstream end portion of the suppressing plate 139 is inclined slightly upward. This suppresses catching of the medium P by the suppressing plate 139 when the medium P is supplied with a large lifting-off formed therein.

Herein, in view of the above-described functions, the horizontal portions 135 of the lifting-off suppressing members 133L and 133R, the suppressing plate 139, and the inclined portions 134 are separately defined as first lifting-off suppressors, a second lifting-off suppressor, and a third lifting-off suppressor, respectively.

The Receding Mechanism and an Advancing/Retreating Member

Next, based on FIGS. 10 to 12D and 17A to 17D, the receding mechanism 111 is described. The receding mechanism 111 includes an advancing/retreating member 103 provided on the rotation shaft 99 of the transport roller 75. The advancing/retreating member 103 repeatedly performs, linked with the rotation of the rotation shaft 99 of the transport roller 75, pushing of the support member 53 and retreating from the support member 53.

Furthermore, the receding mechanism 111 includes a first cam member 101 made integral with the rotation shaft 99 of the transport roller 75. The first cam member 101 causes the advancing/retreating member 103 to perform, linked with the rotation of the rotation shaft 99 of the transport roller 75, the pushing and the retreating.

The advancing/retreating member 103 has a flat plate shape elongated in the ejecting direction Y as illustrated in FIGS. 10 and 11. An end portion on the downstream side of the advancing/retreating member 103 in the ejecting direction Y has an arc shape (FIGS. 17A to 17D) having a large radius of curvature. This end portion serves as a pushing actuator 145 that abuts the support plate 59 of the support member 53 so as to cause the support member 53 to recede by a specified distance S (for example, 1 to 10 mm; FIGS. 12C and 17C to be referred to later).

Furthermore, the advancing/retreating member 103 has a first fitting elongated hole 117 (FIG. 11) and a second fitting elongated hole 119 (FIG. 10). The first fitting elongated hole 117 is fitted onto the rotation shaft 99 of the transport roller 75. The second fitting elongated hole 119 is fitted onto a guide shaft 121 attached to the side wall portion 143 (FIG. 9) of the sub-frame 141. The advancing/retreating member 103 can repeatedly perform the above-described pushing and retreating within the length of these two elongated holes 117 and 119.

Furthermore, a first shift pin 113 and a second shift pin 115 spaced apart from each other by a specified distance in the ejecting direction Y are provided on a surface of the advancing/retreating member 103 on the transport roller 75 side. The first shift pin 113 and the second shift pin 115 project toward the transport roller 75. Out of the first shift pin 113 and the second shift pin 115, the first shift pin 113 abuts the first cam member 101 so as to cause the advancing/retreating member 103 to move in the pushing direction with respect to the support member 53. In contrast, the second shift pin 115 abuts the first cam member 101 so as to cause the advancing/retreating member 103 to move in the retreating direction.

Furthermore, referring to FIG. 11, a spring denoted by a reference sign 147 pulls the first shift pin 113 of the advancing/retreating member 103 toward the first cam member 101 so as to cause the first shift pin 113 to abut the first cam member 101.

The Position Maintaining Mechanism: the Constant Force Spring

Figure 13:
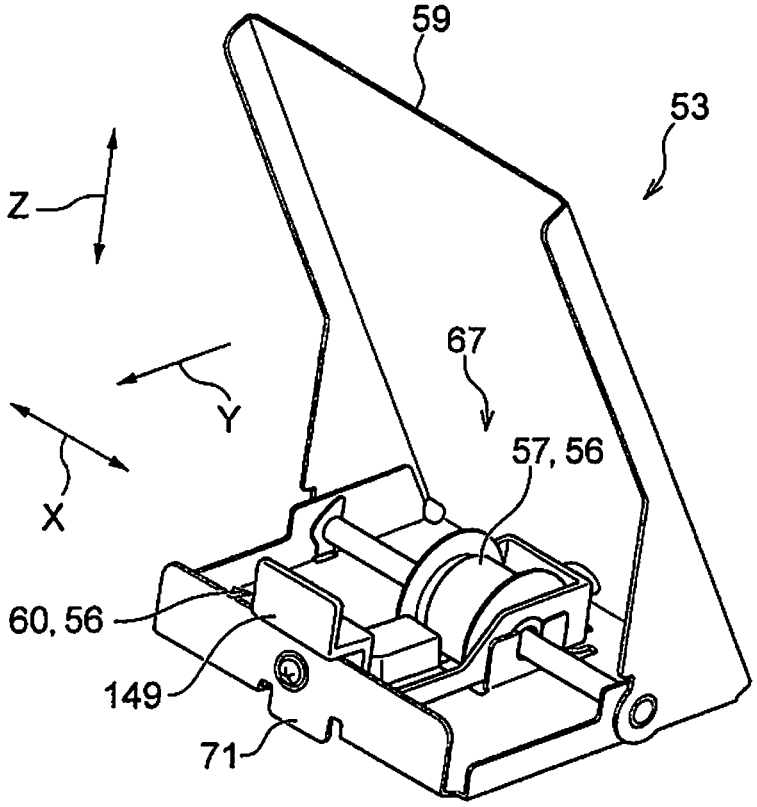
FIG. 13 is a perspective view of the support member and the position maintaining mechanism of the stacker according to the embodiment seen from a diagonally upper left side.
Figure 14:
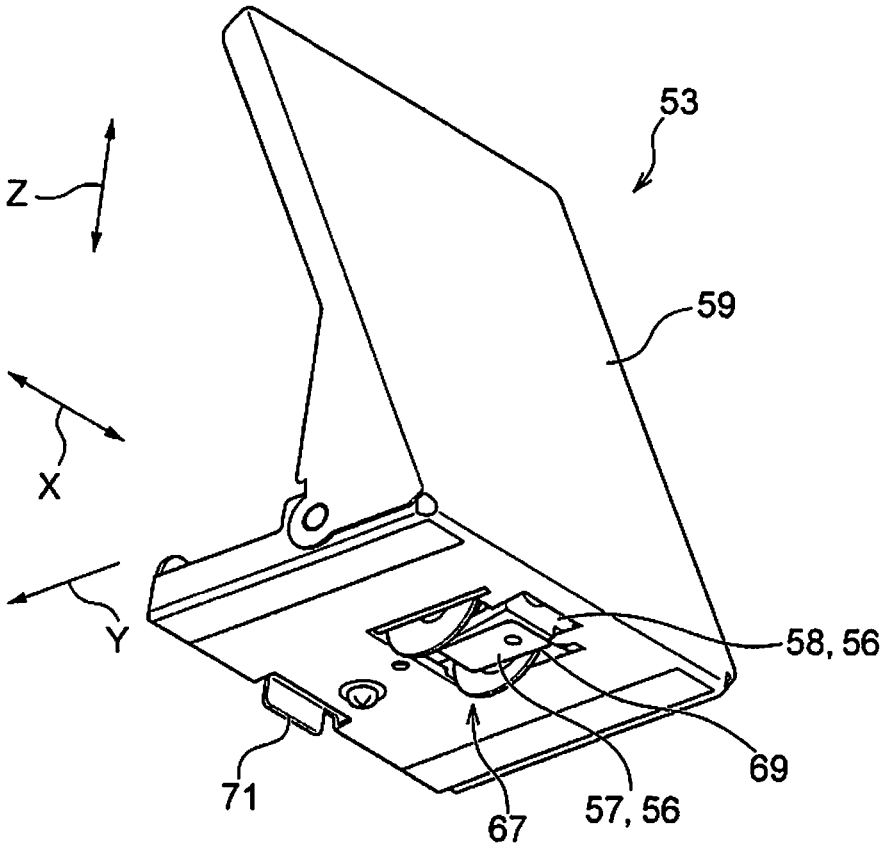
FIG. 14 is a perspective view of the support member and the position maintaining mechanism of the stacker according to the embodiment seen from a diagonally lower left side.

Next, based on FIGS. 13 to 15, the position maintaining mechanism 56 is described. As has been described, the position maintaining mechanism 56 includes the pulling mechanism 57 and the suppressing mechanism 58. According to the present embodiment, the pulling mechanism 57 includes, for example, the constant force spring 57 formed by winding an elongated plate spring to have a spiral shape.

An unwound end 69 of the constant force spring 57 is fixed by a fixing screw (not illustrated) or the like to a portion of the base frame 37 near a position where the transport roller 75 is provided (FIGS. 6 and 15). Accordingly, a force to move the support member 53 toward the upstream side in the ejecting direction Y is generated by utilizing a force of the constant force spring 57 for restoration of the original shape.

Furthermore, the suppressing mechanism 58 according to the present embodiment includes the regulating portion 58 that includes, for example, a wedge-shaped member regulating the rotation of the constant force spring 57 in the winding direction. Instead of the wedge-shaped member, another member that similarly acts such as a one-way roller can be used as the regulating portion 58.

Furthermore, as illustrated in FIG. 13, the regulation release lever 60 that switches the state of the regulating portion 58 between a regulating state and a regulation release state is provided in the support member 53. The regulation release lever 60 is connected to the regulating portion 58 at an end on the upstream side in the ejecting direction Y and provided with an operating portion 149 at an end on the downstream side in the ejecting direction Y.

In order to move the support member 53 positioned at the maximum stack position or at a midway in the stacking region 27 (FIG. 15) of the stacker 21 toward a stack start position at an upstream end in the ejecting direction Y, the operating portion 149 of the regulation release lever 60 is pushed toward the upstream side in the ejecting direction Y so as to separate the regulating portion 58 from the wound portion of the constant force spring 57. Thus, regulation performed by the regulating portion 58 is released.

In contrast, in order to set the regulating portion 58 in the regulating state again, a force to return the operating portion 149 toward the downstream side in the ejecting direction Y is applied by the spring 74 so as to cause the regulating portion 58 to abut the wound portion of the constant force spring 57 again. Thus, the regulating portion 58 is set to the regulating state.

Other than this, a retaining claw 71 projects downward on a lower surface of the slide block 61 that includes the winding mechanism 67 of the constant force spring 57. The retaining claw 71 is retained in a slit-shaped retaining hole 73 (FIGS. 6 and 15) formed at a central portion near a downstream end of the base frame 37 in the ejecting direction Y. Thus, the support member 53 can be kept at the maximum stack position where the support member 53 has receded rearward as much as possible.

Thus, in the stacker 21, the support member 53 can be removably fixed to the base frame 37 when the support member 53 has been receded to the maximum stack position.

The Position Maintaining Mechanism: Frictional Resistance at a Sliding Surface

The receding mechanism 111 may apply, when the support member 53 is receding, a moving force G to move the support member 53 against a frictional force R due to frictional resistance with the stacking surface 22, which is a sliding surface, and the position maintaining mechanism 56 may maintain the position of the support member 53 by utilizing the frictional resistance. That is, the support member 53 may stand still at its position due to the frictional resistance when the moving force G against the frictional force R is not applied.

With the above-described structure, the position of the support member 53 having been moved by the receding mechanism 111 can be maintained at the position by utilizing the frictional force of the sliding surface. Accordingly, the position maintaining mechanism 56 can be realized with a simple structure in which the constant force spring or the like is not used.

The Nip Release Mechanism

Next, based on FIGS. 12A to 12D and 17A to 17D, the nip release mechanism 106 is described.

For example, the nip release mechanism 106 includes a second cam member 105, a first shift lever 123, and a second shift lever 127. The second cam member 105 is made integral with the rotation shaft 99 of the transport roller 75. The first shift lever 123 has one end 123*a* that abuts the second cam member 105, another end 123*b* provided with a shaft 124, and an intermediate portion 123*c* to which a spring 125 that pulls the intermediate portion 123*c* upward is attached. The second shift lever 127 has one end 127*a* (FIG. 10) that abuts a lower surface of the intermediate portion 123*c* of the first shift lever 123 and another end 127*b* at which the second shift lever 127 is fixed to the pivot shaft 129 of the nipping member 107 with a fixing screw 128.

The second cam member 105 pushes the one end 123*a* of the first shift lever 123 downward by a specified amount when the pushing of the advancing/retreating member 103 is performed. Furthermore, the one end 127*a* of the second shift lever 127 is pushed downward by a specified amount due to tilting of the first shift lever 123 about the tilting shaft 124.

Thus, the pivot shaft 129 attached to the other end 127*b* of the second shift lever 127 pivots by a specified angle. This causes the nipping member 107 attached to the pivot shaft 129 with the fixing screw 130 to pivot in a direction separating from the transport roller 75. Accordingly, the nipping roller 109 provided at the pivot free end of the nipping member 107 is separated from the transport roller 75, thereby the nip is released.

The relationships between the advancing/retreating member 103, the nipping member 107, and the nip release mechanism 106 having been described are summarized as follows.

The stacker 21 according to the present embodiment includes a nipping member 107 that, together with the transport roller 75, nips the medium P therebetween and transmits a transport force of the transport roller 75 to the medium P while nipping the medium P. When the advancing/retreating member 103 performs the pushing by which the support member 53 is caused to recede by the specified distance S (FIGS. 12C and 17C), the nipping between the transport roller 75 and the nipping roller 109 is released.

Furthermore, the nipping member 107 can be displaced between a position where the nipping member 107 together with the transport roller 75 forms a nip therebetween and a position where the nip between the nipping member 107 and the transport roller 75 is released. The second cam member 105 provided on the rotation shaft 99 of the transport roller 75 is moved in accordance with the rotation of the rotation shaft 99 of the transport roller 75, thereby displacing the nipping member 107 between the nipping state and the nip release state.

With the nip release mechanism 106 that has the above-described structure and performs the above-described operations, the nipping member 107 is set in the nip release state while the advancing/retreating member 103 is pushing the surface of the support plate 59 of the support member 53 with the medium P pinched therebetween. Thus, the transport force of the transport roller 75 is reduced, thereby reducing jamming, creasing, and the like of the medium P.

Furthermore, a certain gap (for example, 1 to 10 mm) is formed between the transport roller 75 and the medium P supported by the support member 53, so that the succeeding medium P being ejected is stacked along the front side of the medium P having been stacked and supported so as to be inclined as has been describe. This operation is realized by the above-described receding mechanism 111 and the position maintaining mechanism 56.

4. Operating Form of the Processing Apparatus (see FIGS. 4, 5, and 12A to 18B)

Next, an operating form of the processing apparatus 1 according to the present embodiment is described by focusing on the operation of the stacker 21 according to the present embodiment with an example case where a plurality of the media P such as postcards or envelopes on which processes of recording addresses, text, or the like have been performed are stacked by using the stacker 21.

In the following description, the operating form of the processing apparatus 1 is divided into four steps as follows: (A) mounting of the stacker; (B) preparation for stacking; (C) start of the stacking; and (D) end of the stacking and removal of the media.

A. Mounting of the Stacker (See FIGS. 4 and 5)

Figure 5:
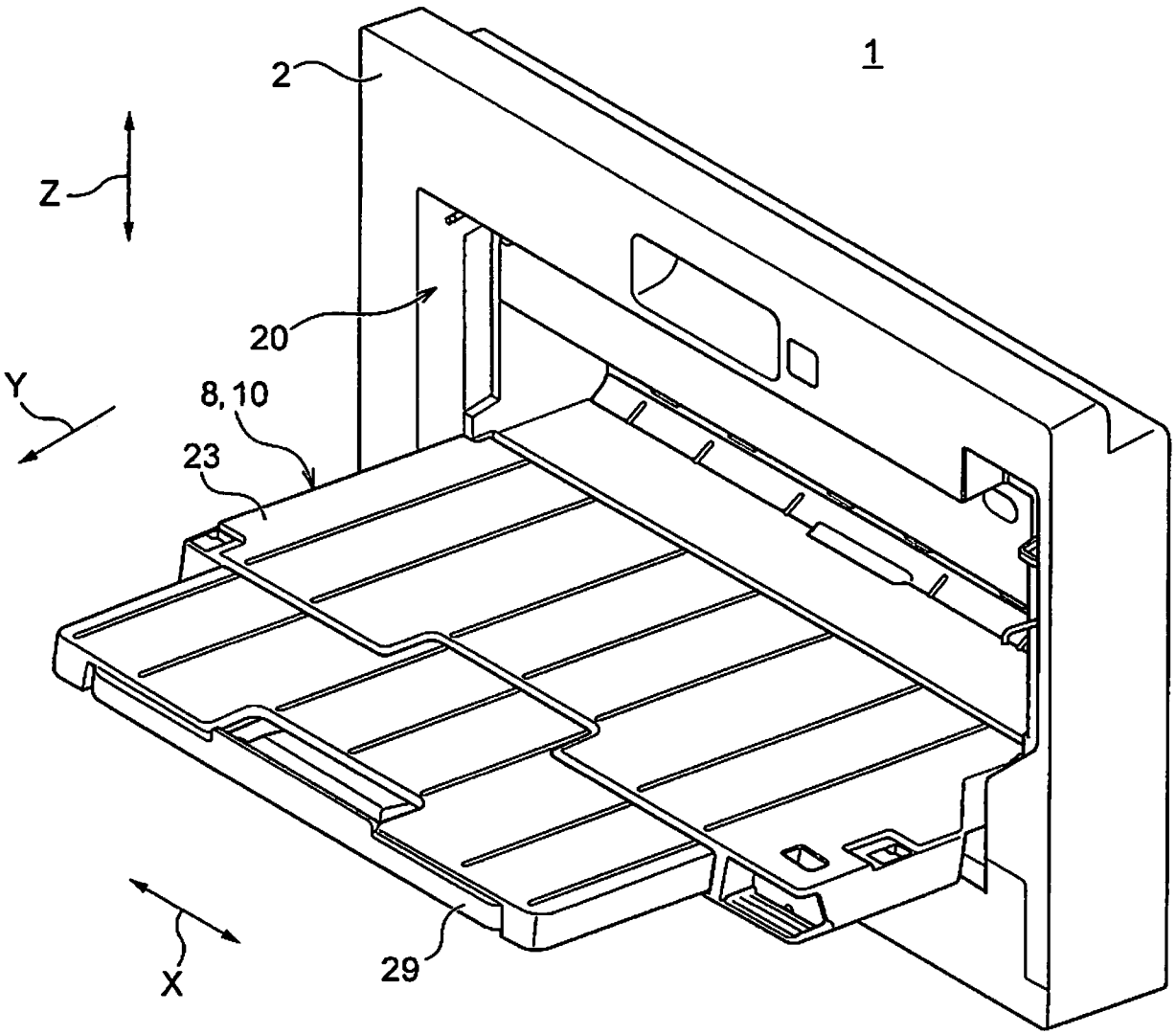
FIG. 5 is a perspective view illustrating a use state of the ejection unit of the processing apparatus according to the embodiment.

First, the handle (not illustrated) provided in the front surface of the medium ejection tray 8 closing the ejection opening 20 formed in the side surface of the apparatus main body 2 is held by a hand so as to open the medium ejection tray 8 as illustrated in FIG. 5. In this state, the rear surface of the medium ejection tray 8 becomes the obverse side and the placement surface 23 is exposed.

Next, the stacker 21 is placed on the placement surface 23 and positioned by, for example, fitting projections (not illustrated) or the like formed on a lower surface of the base frame 37 of the stacker 21 into recesses (not illustrated) or the like formed in the placement surface 23.

Figure 4:
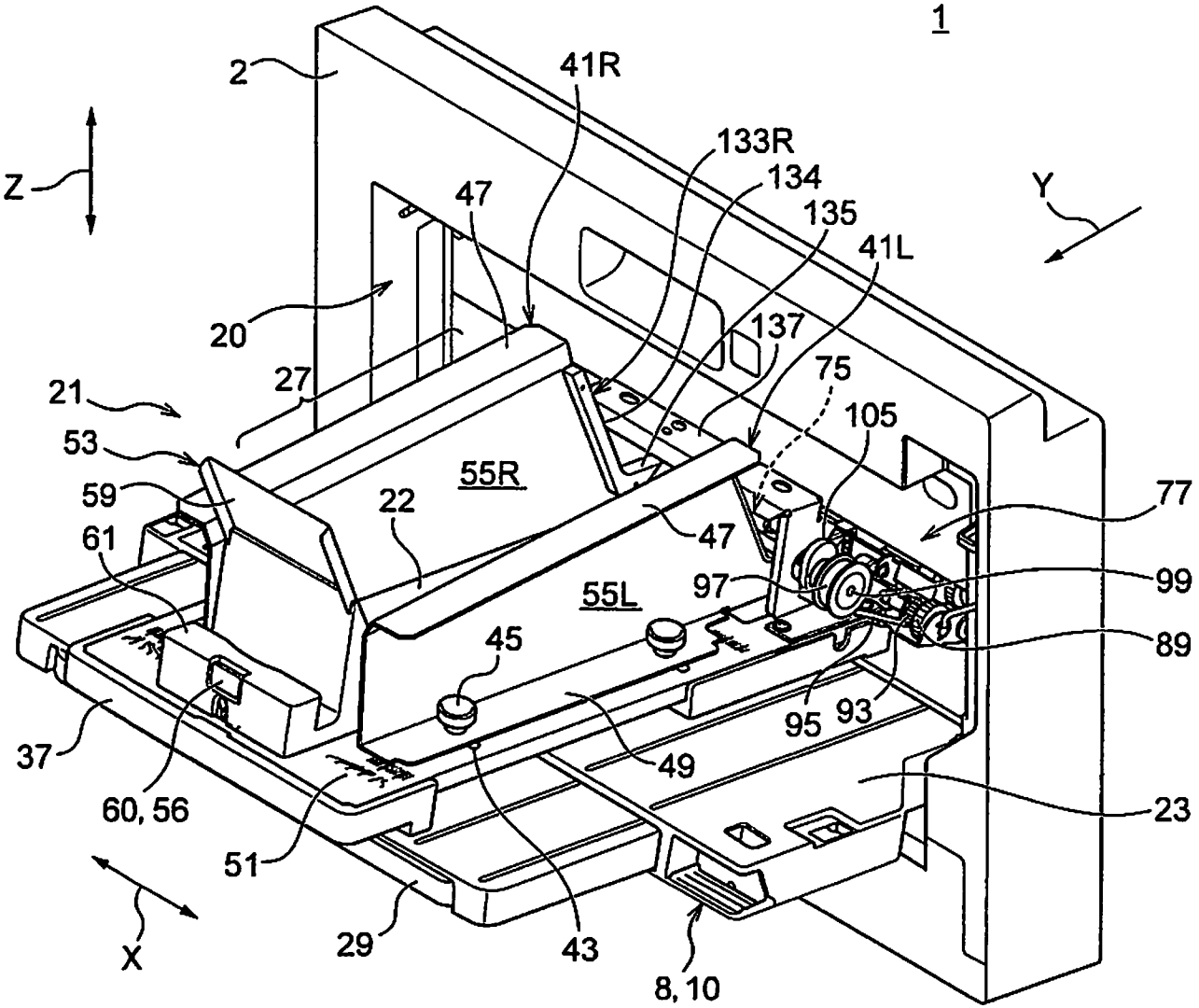
FIG. 4 is a perspective view illustrating a state in which a stacker is disposed in an ejection unit of the processing apparatus according to the embodiment.

In so doing, the upstream side of the stacker 21 in the ejecting direction Y is inserted into the ejection opening 20 while being slightly inclined downward so as to perform the positioning with the projections or the like and the recesses or the like. After that, the downstream end side of the stacker 21 in the ejecting direction Y is moved downward so as to mount the stacker 21 on the placement surface 23 as illustrated in FIG. 4.

In this state, movements of the stacker 21 in the XY plane parallel to the placement surface 23 of the medium ejection tray 8 are regulated by the engagement of the projections or the like with the recesses or the like, and movements of the stacker 21 are also regulated in the vertical direction Z by abutment of an upper surface of the top plate portion of the support frame 137 having an inverted U shape provided in the space on the upstream side of the base frame 37 in the ejecting direction Y against a lower surface or the like of a top plate portion of the ejection opening 20.

Furthermore, as illustrated in FIG. 9, when the stacker 21 is mounted on the placement surface 23 of the medium ejection tray 8, the transmission rollers 79L and 79R, which are provided at the upstream end of the stacker 21 in the ejecting direction Y abut the ejection rollers 18L and 18R, which are provided in the ejection unit 10 of the processing apparatus 1. This allows the motive power to be transmitted to the transport roller 75 of the stacker 21 via the power transmission unit 77. Accordingly, high-speed stacking of the media P in the edge placement orientation (standing orientation) can be performed.

B. Preparation for Stacking (See FIGS. 13 to 16 and 18B)

Figure 18A:
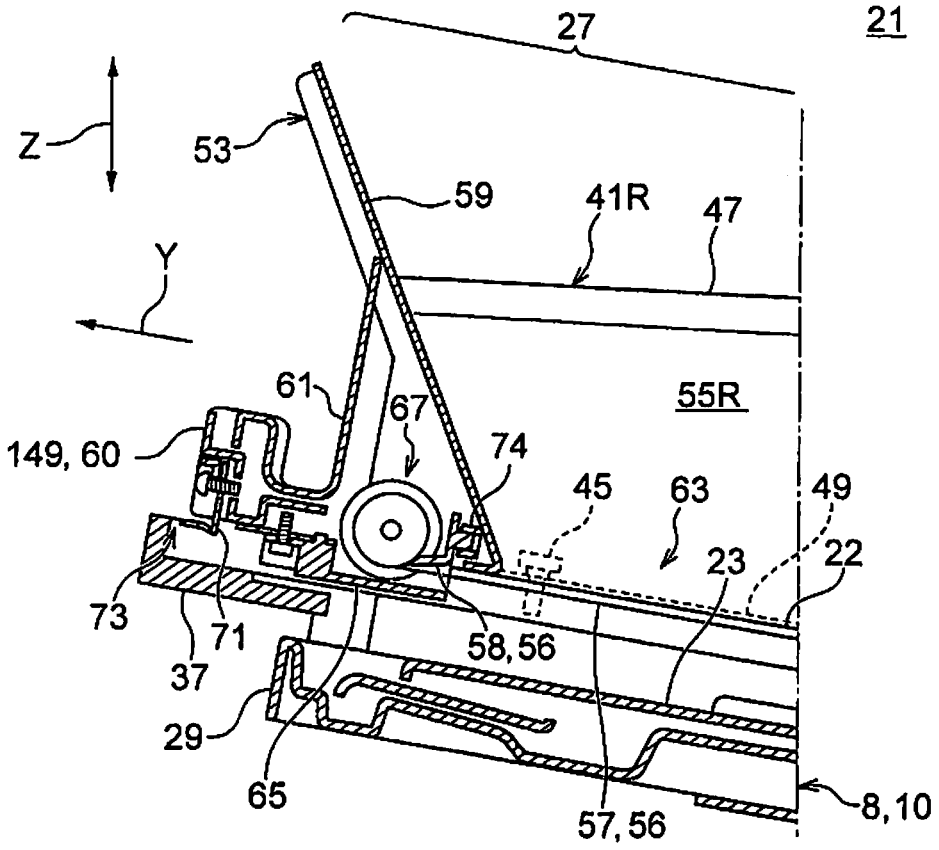
FIG. 18A is a side sectional view illustrating the operation of the stacker according to the embodiment with a regulating portion set in a regulating state.

Next, the handle portions 47 are held so as to adjust the distance between the left and right side guide portions 41L and 41R in accordance with the width of the media P to be stacked, and the fixing screws 45 are tightened so as fix the positions where the side guide portions 41L and 41R are attached. Next, when the support member 53 is fixed at the maximum stack position at the downstream end in the ejecting direction Y as illustrated in FIG. 18A, the retaining claw 71 projecting from a lower end of the slide block 61 of the support member 53 is pulled out from the retaining hole 73 formed near the downstream end in the upper surface of the base frame 37 in the ejecting direction Y. Thus, the fixed state of the support member 53 is released.

Figure 18B:
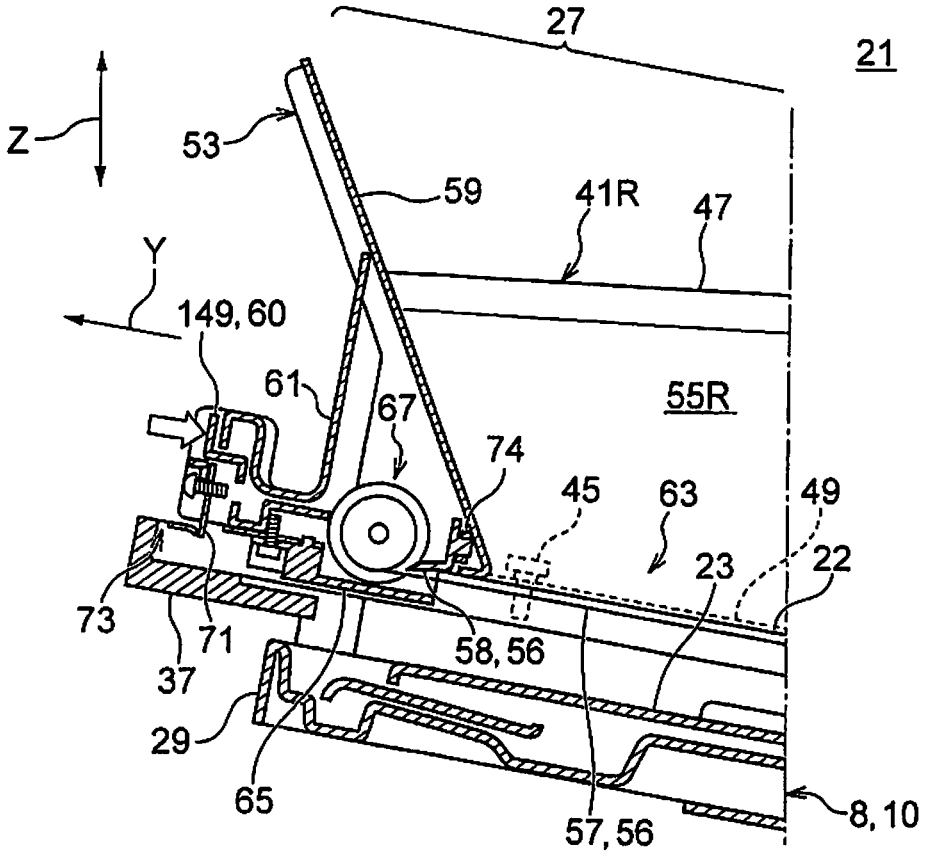
FIG. 18B is a side sectional view illustrating the operation of the stacker according to the embodiment with the regulating portion set in a regulation release state.

Along with the releasing of the fixing, as illustrated in FIG. 18B, the regulation release lever 60 provided in the support member 53 is pushed toward the upstream side in the ejecting direction Y so as to separate the regulating portion 58 from the wound portion of the constant force spring 57. This releases the regulation of the movement of the support member 53 by the regulating portion 58 toward the upstream side in the ejecting direction Y.

As a result of the above-described operation, the force of the constant force spring 57 for restoration of the original shape acts on the support member 53. Thus, the support member 53 can be moved to the stack start position at the upstream end in the ejecting direction Y while being guided by the projection 65 and the guide hole 63 (FIG. 16). Then, after the support member 53 has been moved to the stack start position, a force to return to the downstream side in the ejecting direction Y is caused to act on the regulation release lever 60 (operating portion 149). Thus, the regulating portion 58 abuts the wound portion of the constant force spring 57 again. In this way, the movement of the support member 53 toward the upstream side in the ejecting direction Y is regulated. Here, the regulating portion 58 regulates the movement of the support member 53 toward the upstream side and does not regulate the movement of the support member 53 toward the downstream side in the ejecting direction Y.

C. Start of the Stacking (See FIGS. 12A to 12D, 16 and 17A to 17D)

After the preparation for the stacking has been completed, specified processes of the processing apparatus 1 are performed on the medium P fed from the medium feed tray 7. The medium P on which the processes have been performed is ejected to the outside of the apparatus main body 2 from the ejection unit 10.

The ejection of the medium P is performed by rotating the ejection rollers 18. The rotation of the ejection rollers 18 is transmitted to the transport roller 75 via the power transmission unit 77, thereby the transport roller 75 is rotated in a direction in which the medium P is fed to the stacking region 27 of the stacker 21.

The medium P ejected by the ejection rollers 18 is guided by the entrance guides 136 and moved to the stacker 21 side with side end portions thereof positioned in the gaps between the horizontal portions 135 of the left and right lifting-off suppressing members 133L and 133R and the upper surface of the base frame 37. The medium P is transported in the face placement orientation (lying orientation) along the upper surface of the base frame 37 until a leading end thereof reaches a nipping point O (FIGS. 15 and 16) between the transport roller 75 and the nipping member 107.

When curl or the like occurs in the medium P being transported, lifting-off at the left and right side end portions of the medium P is suppressed by the horizontal portions 135 (first lifting-off suppressors) of the lifting-off suppressing members 133. Lifting-off or bulging in the central portion of the medium P is suppressed by the suppressing plate 139 (second lifting-off suppressor; FIG. 9) integral with the sub-frame 141.

When the leading end of the medium P reaches the nipping point O, the medium P is nipped between the transport roller 75 and the nipping roller 109. Thus, the feeding force of the transport roller 75 is transmitted to the leading end of the medium P. Then, the leading end of the medium P is caused to abut the surface of the support plate 59 of the support member 53 on the downstream side.

The leading end of the medium P abutting the surface of the support plate 59 is guided by the inclined surface of the support plate 59 without being changed and moved diagonally upward along the surface.

Then, when a trailing end of the medium P has passed through the nipping point O, the medium P no longer receives the feeding force from the transport roller 75. Thus, a trailing end edge of the medium P is caused to abut the stacking surface 22 of the stacker 21, and the medium P assumes the edge placement orientation (standing orientation) in which the back side of the medium P is supported by the support member 53. Thus, stacking of a single medium P is completed.

At this time, the side end portions of the medium P in the width direction X are positioned in the gaps between the rear surfaces of the inclined portions 134 of the lifting-off suppressing members 133 and the front surface of the support plate 59. Thus, lifting-off of the left and right side end portions of the medium P is suppressed by the inclined portions 134 (third lifting-off suppressor). Accordingly, transition of the orientation and transportation of the medium P are smoothly performed.

Furthermore, operations of the receding mechanism 111 and the nip release mechanism 106 are started in accordance with the rotation of the rotation shaft 99 of the transport roller 75. Out of these, due to the rotation of the rotation shaft 99 of the transport roller 75, the first cam member 101 is rotated so as to move the advancing/retreating member 103 in the receding mechanism 111 such that the advancing/retreating member 103 is pushed toward the support member 53 by the specified distance S.

This causes the support member 53 to recede by the specified distance S, thereby ensuring a space for stacking the medium P to be ejected next between the surface of the medium P having been stacked and the transport roller 75.

Furthermore, at this time, the movement of the support member 53 toward the upstream side in the ejecting direction Y is regulated by the regulating portion 58 of the position maintaining mechanism 56. Thus, the support member 53 is stopped at a position where the support member 53 has receded by the specified distance S without being changed and ready for stacking of the next medium P.

Furthermore, the nip release mechanism 106 also performs a specified operation in synchronization with the operation of the receding mechanism 111. That is, due to the rotation of the rotation shaft 99 of the transport roller 75, the second cam member 105 is rotated so as to push downward the one end 123*a* of the first shift lever 123. Thus, the first shift lever 123 is tilted downward against a force of the spring 125 directed upward.

The downward tilting of the first shift lever 123 pushes downward the one end 127*a* of the second shift lever 127 and causes the pivot shaft 129 attached to the other end 127*b* to pivot in a direction in which the pivot free end of the nipping member 107 is pushed downward.

This operation moves the nipping roller 109 from a nip position where the nipping roller 109 contacts a circumferential surface of the transport roller 75 to a nip release position where the nipping roller 109 is kept separated from the circumferential surface of the transport roller 75. Thus, transmission of the feeding force to the medium P is stopped.

Thus, the feeding force transmitted from the transport roller 75 is reduced by releasing the nipping state between the transport roller 75 and the nipping member 107 when the receding mechanism 111 causes the advancing/retreating member 103 to perform the pushing. This suppresses the occurrence of creasing or the like in the medium P.

Figure 12A:
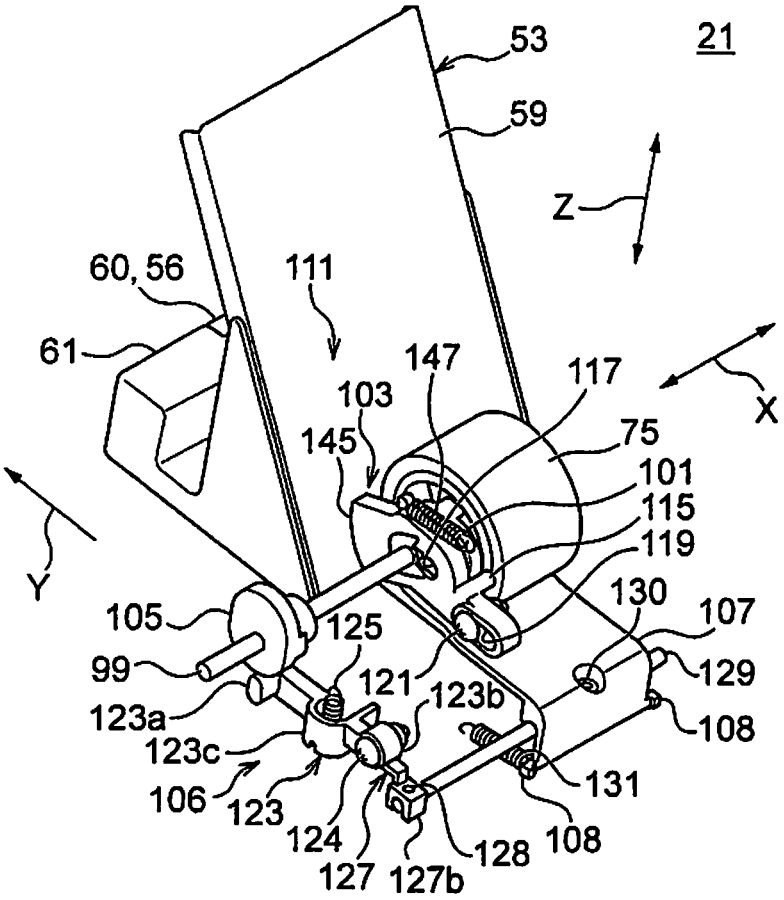
FIG. 12A is a perspective view of the receding mechanism illustrating operation of the stacker according to the embodiment, specifically illustrating a state in which an advancing/retreating member has been retreated.
Figure 12B:
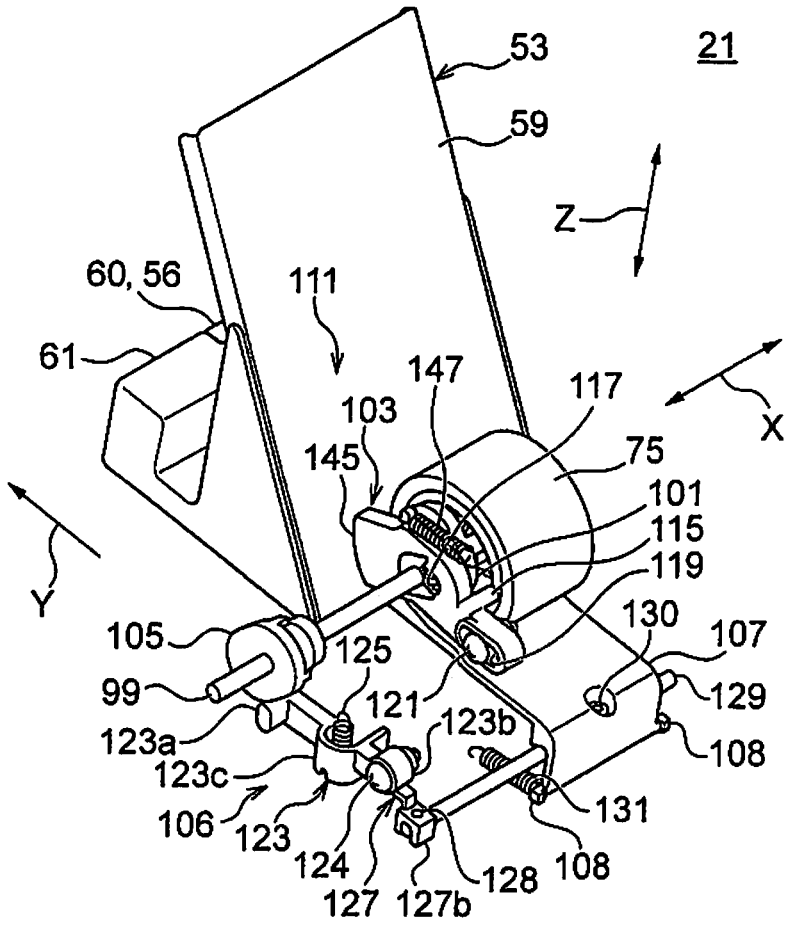
FIG. 12B is a perspective view of the receding mechanism illustrating the operation of the stacker according to the embodiment, specifically illustrating a state in which the advancing/retreating member is being pushed.
Figure 12C:
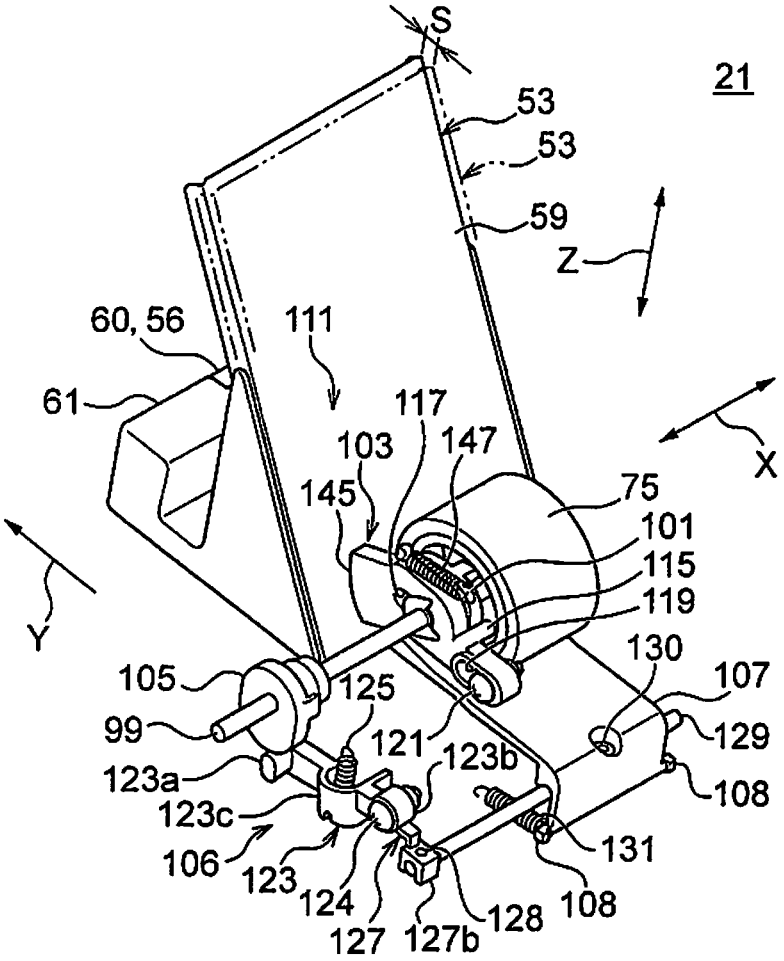
FIG. 12C is a perspective view of the receding mechanism illustrating the operation of the stacker according to the embodiment, specifically illustrating a state in which the advancing/retreating member has been pushed.
Figure 17A:
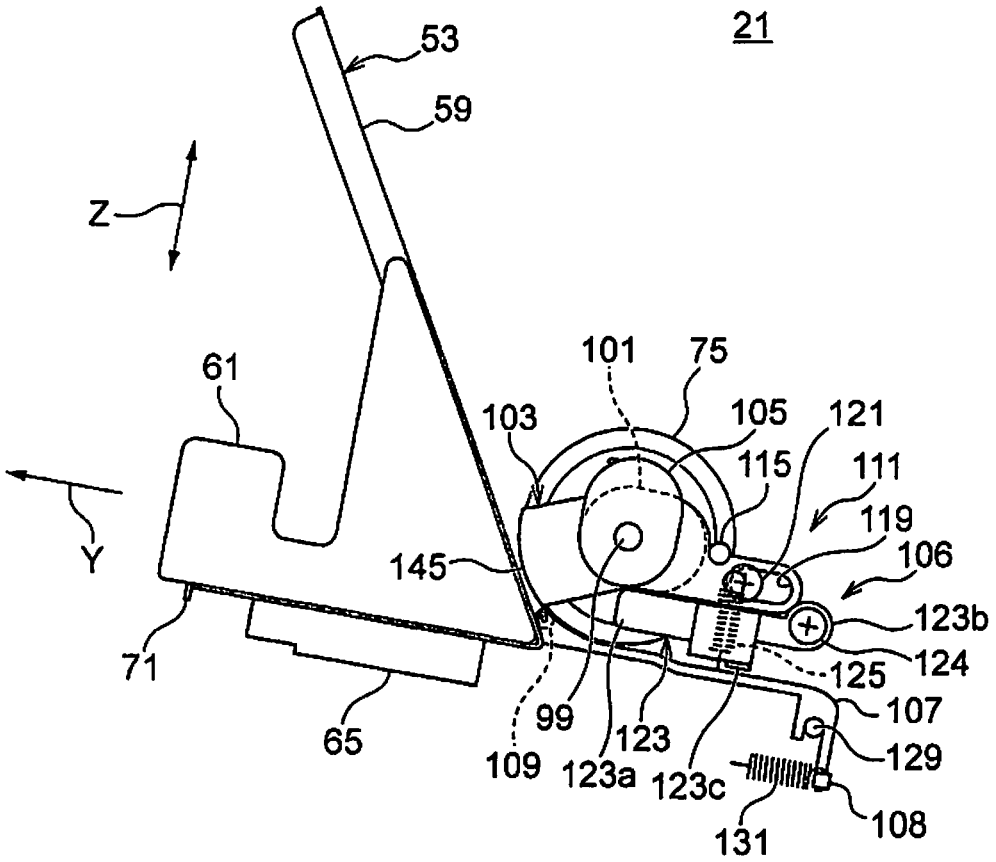
FIG. 17A is a side view of the receding mechanism illustrating the operation of the stacker according to the embodiment, specifically illustrating a state in which the advancing/retreating member has been retreated.
Figure 17B:
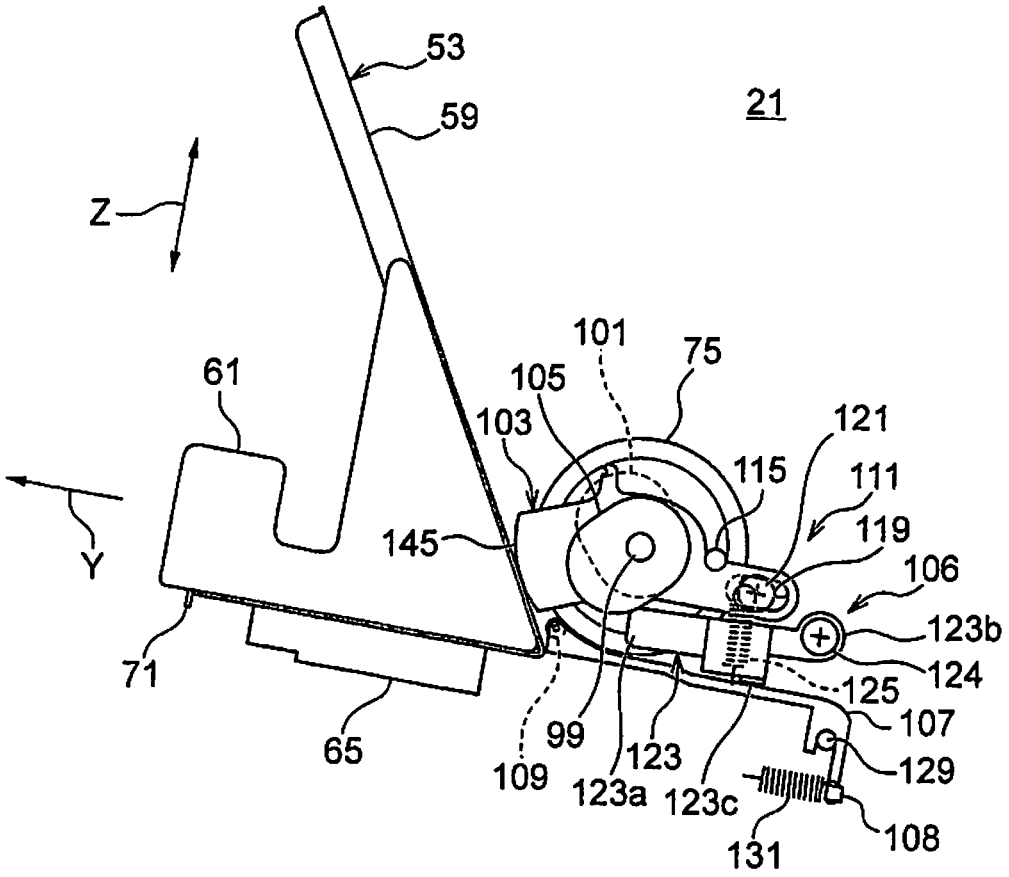
FIG. 17B is a side view of the receding mechanism illustrating the operation of the stacker according to the embodiment, specifically illustrating a state in which the advancing/retreating member is being pushed.
Figure 17C:
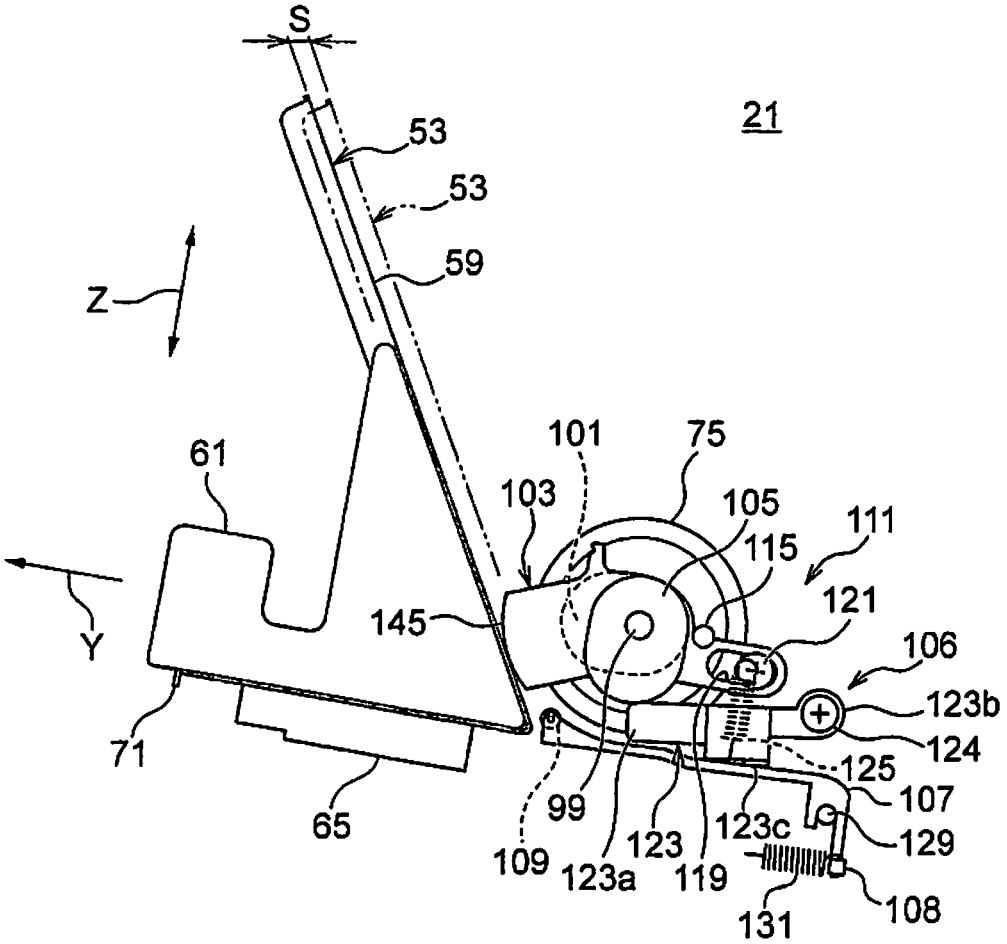
FIG. 17C is a side view of the receding mechanism illustrating the operation of the stacker according to the embodiment, specifically illustrating a state in which the advancing/retreating member has been pushed.

Next, based on FIGS. 12A to 12D and 17A to 17D, the relationship between the position of the advancing/retreating member 103 and the nipping state or the nip release state between the transport roller 75 and the nipping member 107 is described. As illustrated in FIGS. 12A and 17A, immediately after the leading end of the medium P has reached the nipping point O, the medium P is subjected to a large feeding force from the transport roller 75 and the nipping member 107 in the nipping state, and transportation of the medium P starts.

At this time, the advancing/retreating member 103 is disposed at a retreated position where the advancing/retreating member 103 has been retreated to the upstream side in the ejecting direction Y, and the nipping member 107 is in the nipping state in which the nipping roller 109 abuts the circumferential surface of the transport roller 75 with the medium P nipped therebetween.

When the rotation shaft 99 of the transport roller 75 continues rotating and the stacker 21 enters a state illustrated in FIGS. 12B and 17B, the advancing/retreating member 103 is gradually advancing in the pushing direction. Furthermore, the nipping member 107 starts pivoting downward about the pivot shaft 129. Thus, a nipping force of the transport roller 75 and the nipping member 107 acting on the medium P is reduced, and accordingly, the feeding force acting on the medium P is reduced.

Furthermore, the rotation shaft 99 of the transport roller 75 continues rotating and the stacker 21 enters a state illustrated in FIGS. 12C and 17C, the advancing/retreating member 103 is moved to a pushing position on the downstream side in the ejecting direction Y. Thus, the support member 53 is pushed in so as to recede by the specified distance S. At this time, the nipping member 107 pivots further so as to enter the nip release state in which the nipping roller 109 is kept separated from the circumferential surface of the transport roller 75.

Figure 12D:
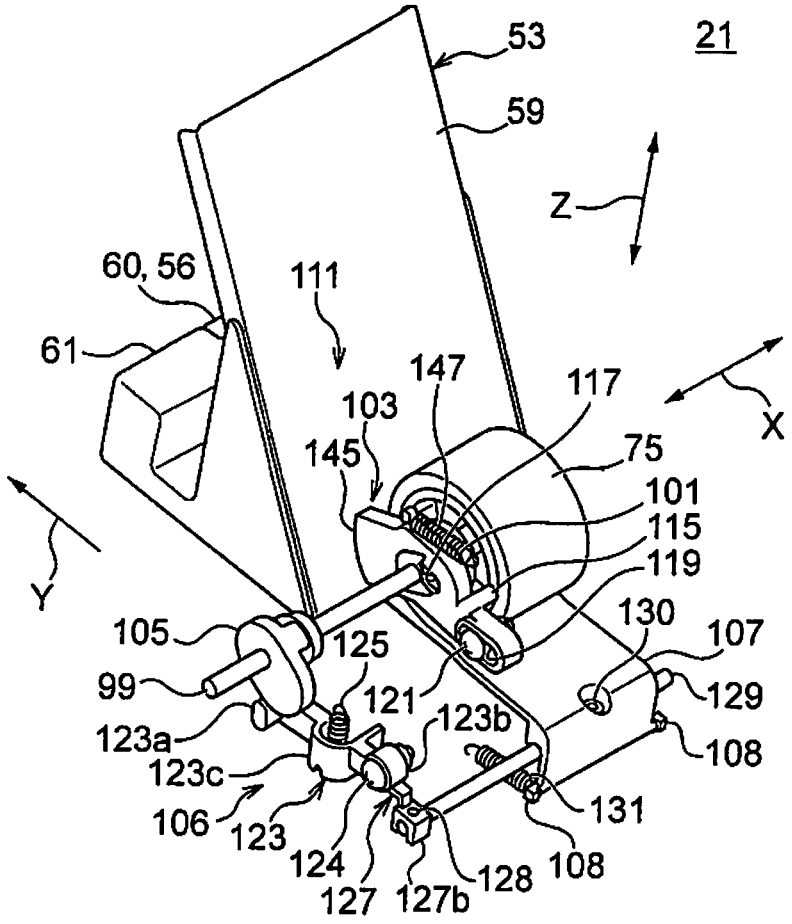
FIG. 12D is a perspective view of the receding mechanism illustrating the operation of the stacker according to the embodiment, specifically illustrating a state in which the advancing/retreating member is retreating.
Figure 17D:
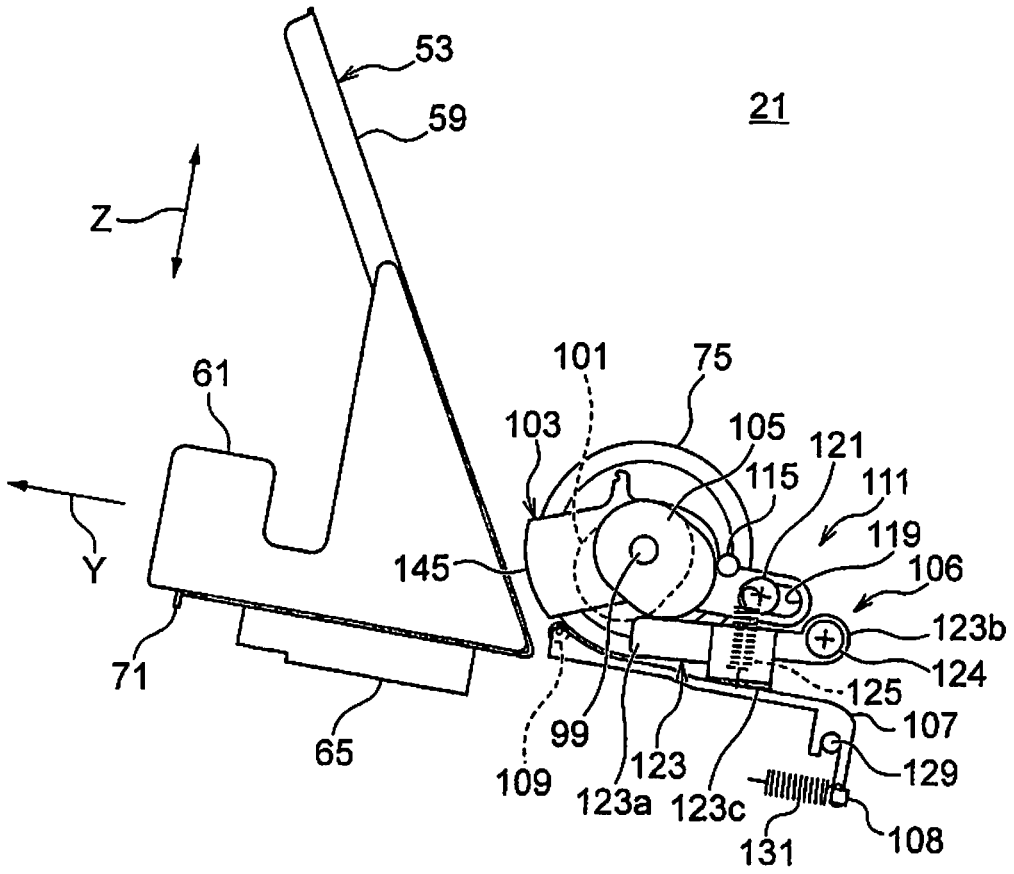
FIG. 17D is a side view of the receding mechanism illustrating the operation of the stacker according to the embodiment, specifically illustrating a state in which the advancing/retreating member is retreating.

Furthermore, when the rotation shaft 99 of the transport roller 75 continues rotating and the stacker 21 enters a state illustrated in FIGS. 12D and 17D, the advancing/retreating member 103 is gradually being retreated toward the above-described "position". The nipping member 107 starts pivoting upward about the pivot shaft 129. Thus, the nipping force of the transport roller 75 and the nipping member 107 acting on the medium P is gradually increased, and accordingly, the feeding force acting on the medium P is increased.

Then, when the rotation shaft 99 of the transport roller 75 continues rotating further, the state of the stacker 21 returns to the state illustrated in FIGS. 12A and 17A. After this, as the similar operations are being repeatedly performed, the media P are sequentially stacked one after another in the stacking region 27 of the stacker 21, and the support member 53 recedes on a specified-distance-S by specified-distance-S basis.

D. End of the Stacking and Removal of the Media (See FIGS. 15 and 18A to 18B)

When all the media P have been processed, a single medium P that is the last one of the media P is ejected to the outside of the apparatus main body 2 by the ejection rollers 18 through the ejection opening 20. The medium P ejected by the ejection rollers 18 is transported toward the stacking region 27 through the transport operation performed by the transport roller 75 and the nipping member 107. Thus, stacking of all the media P is completed.

After the stacking of all the media P has been completed, the support member 53 is moved to the maximum stack position at the downstream end in the ejecting direction Y, and the retaining claw 71 projecting from the lower end of the slide block 61 of the support member 53 is retained in the retaining hole 73 formed in the base frame 37. Thus, the support member 53 is fixed at the maximum stack position. This increases ease of removal of the media P stacked in the stacking region 27, and combined with the fact that the height of the guide side plates 55L and 55R of the side guide portions 41L and 41R is reduced on the downstream side in the ejecting direction Y, the media P is smoothly removed.

With the stacker 21 and the processing apparatus 1 according to the present embodiment having the above-described structures, the media P stacked in the stacker 21 assume such an edge placement orientation (standing orientation) in which the media P are inclined with the upper portion thereof being further in the ejecting direction Y than the lower portion thereof. Accordingly, compared to the related-art processing apparatus that does not use the stacker 21 and stacks the media P in the face placement orientation (lying orientation) on the placement surface 23 of the medium ejection tray 8, the number of the media P to be stacked can be significantly increased.

Furthermore, with the receding mechanism 111 and the position maintaining mechanism 56, the position of the support member 53 can gradually recede in accordance with the progress of stacking of the media P and kept instead of being constantly fixed at the maximum stack position. Thus, the need of a conveyer belt or the like that transports the media P to the maximum stack position is dropped, and accordingly, the techniques herein can contribute to reduction in size, weight, and cost of the apparatus. Thus, it is possible to provide the stacker 21 that has a large stacking capacity so as to be usable with a high-speed processing apparatus performing specified processes at high speed and that is capable of continuous stacking, and it is also possible to provide the processing apparatus 1 that includes the stacker 21.

Other Embodiments

Although the stacker 21 and the processing apparatus 1 according to the disclosure basically have the structures having been described, of course, it is possible to change or omit partial structures without departing from the gist of the disclosure.

For example, use of the processing apparatus 1 according to the disclosure is not limited to an ink jet printer. The processing apparatus 1 according to the disclosure can be used for another recording apparatus, copier, or the like such as a laser printer. In addition, the processing apparatus 1 according to the disclosure can be used for any of a variety of other processing apparatuses that perform certain processes on a large amount of the media P at high speed.

Furthermore, instead of the constant force spring 57 used as the pulling mechanism 57, another type of spring of a different method such as a plate spring, coil spring, and a pneumatic spring can be used as the pulling mechanism 57. Furthermore, the power transmission unit 77 does not necessarily have a structure in which the motive power is obtained through pressure contact of the transmission rollers 79 with the ejection rollers 18. The motive power may be obtained from gears, pulleys, or the like for outputting provided on the shaft 25 of the ejection rollers 18.

Furthermore, the media P to be stacked in the stacker 21 are not limited to postcards or envelopes in a portrait format. The media P to be stacked may be postcards or envelopes in a landscape format. Furthermore, the media P may be media P of another type such as business cards or another media having no definite form. Furthermore, it is possible to provide, in the medium ejection tray 8, a sensor that detects whether the stacker 21 is disposed on the placement surface 23 of the medium ejection tray 8. In addition, instead of utilizing the rotation of the existing ejection rollers 18 on the processing apparatus 1 side as the motive power for the transport roller 75, the receding mechanism 111, and the nip release mechanism 106, rotation of a motor that is independently provided in the stacker 21 can be utilized to operate the transport roller 75, the receding mechanism 111, and the nip release mechanism 106.

What is claimed is:

1. A stacker adapted to be mounted to a medium ejection tray which stacks medium ejected through an ejection opening of a processing apparatus in a lying orientation, and to cause the medium to be stacked and placed on a stacking surface in a standing orientation, the stacker comprising:

a support member that is movable toward an upstream side and a downstream side in an ejecting direction, that includes a support plate inclined with an end edge of the support plate on the downstream side in the ejecting direction positioned above an end edge of the support plate on the upstream side in the ejecting direction, that receives each of the medium ejected through the ejection opening, and that supports the medium in such an orientation that an end edge of the medium on the upstream side in the ejecting direction abuts the stacking surface by pushing an end edge of the medium on the downstream side in the ejecting direction upward along the inclination of the support plate;

a receding mechanism that causes the support member to recede toward the downstream side;

a position maintaining mechanism that maintains a position of the support member having been moved by the receding mechanism; and a transport roller that receives the medium ejected through the ejection opening and that transports the medium toward the downstream side, the transport roller being operatively coupled to an ejection roller of the processing apparatus so that the transport roller is driven by motive power from a rotation shaft of the ejection roller, wherein the stacker does not include a conveyor belt for transporting the medium.

2. The stacker according to claim 1, wherein the position maintaining mechanism includes a pulling mechanism that applies to the support member a pulling force to pull toward the upstream side, and a suppressing mechanism that suppresses the pulling force at a position to which the support member has been caused to recede by a specified distance by the receding mechanism.

3. The stacker according to claim 1, wherein in order to recede the support member, the receding mechanism applies a moving force to move against a frictional force caused by frictional resistance with the stacking surface which serves as a surface sliding against the support member, and the position maintaining mechanism maintains the position of the support member by utilizing the frictional resistance.

4. The stacker according to claim 1, wherein the transport roller is driven by transmitting the motive power from the rotation shaft of the ejection roller positioned at a most downstream portion of the processing apparatus in the ejecting direction.

5. The stacker according to claim 1, wherein the receding mechanism includes an advancing/retreating member provided on a rotation shaft of the transport roller, and the advancing/retreating member repeatedly performs, linked with the rotation of the rotation shaft of the transport roller, pushing of the support member and retreating from the support member.

6. The stacker according to claim 5, further comprising:

a nipping member that, together with the transport roller, nips the medium therebetween so as to transmit a transport force of the transport roller to the medium while the medium is being nipped, wherein the nipping is released when the advancing/retreating member performs the pushing.

7. The stacker according to claim 5, wherein the advancing/retreating member has a flat plate shape elongated in the ejecting direction.

8. The stacker according to claim 1, wherein the stacker is a unitized device that is removably mountable in the processing apparatus.

9. A processing apparatus comprising:

a processing unit that performs a specified process on medium;

an ejection mechanism that ejects through an ejection opening the medium transported thereto through the processing unit; and a stacker unit that receives the medium ejected through the ejection opening and stacks the medium, wherein the stacker unit is the stacker according to claim 1.

10. A stacker adapted to be mounted to a medium ejection tray which stacks medium ejected through an ejection opening of a processing apparatus in a lying orientation, and to cause the medium to be stacked and placed on a stacking surface in a standing orientation, the stacker comprising:

a support member that is movable toward an upstream side and a downstream side in an ejecting direction, that includes a support plate inclined with an end edge of the support plate on the downstream side in the ejecting direction positioned above an end edge of the support plate on the upstream side in the ejecting direction, that receives each of the medium ejected through the ejection opening, and that supports the medium in such an orientation that an end edge of the medium on the upstream side in the ejecting direction abuts the stacking surface by pushing an end edge of the medium on the downstream side in the ejecting direction upward along the inclination of the support plate;

a receding mechanism that causes the support member to recede toward the downstream side;

a position maintaining mechanism that maintains a position of the support member having been moved by the receding mechanism; and a transport roller that receives the medium ejected through the ejection opening and that transports the medium toward the downstream side, the transport roller being operatively coupled to an ejection roller of the processing apparatus so that the transport roller is driven by motive power from a rotation shaft of the ejection roller, wherein the receding mechanism includes an advancing/retreating member provided on a rotation shaft of the transport roller, the advancing/retreating member repeatedly performs, linked with the rotation of the rotation shaft of the transport roller, pushing of the support member and retreating from the support member, the receding mechanism includes a first cam member provided on the rotation shaft of the transport roller, and the first cam member causes, linked with the rotation of the rotation shaft of the transport roller, the advancing/retreating member to perform the pushing and the retreating.

11. The stacker according to claim 10, wherein the position maintaining mechanism includes a pulling mechanism that applies to the support member a pulling force to pull toward the upstream side, and a suppressing mechanism that suppresses the pulling force at a position to which the support member has been caused to recede by a specified distance by the receding mechanism.

12. The stacker according to claim 10, wherein in order to recede the support member, the receding mechanism applies a moving force to move against a frictional force caused by frictional resistance with the stacking surface which serves as a surface sliding against the support member, and the position maintaining mechanism maintains the position of the support member by utilizing the frictional resistance.

13. A stacker adapted to be mounted to a medium ejection tray which stacks medium ejected through an ejection opening of a processing apparatus in a lying orientation, and to cause the medium to be stacked and placed on a stacking surface in a standing orientation, the stacker comprising:

a support member that is movable toward an upstream side and a downstream side in an ejecting direction, that includes a support plate inclined with an end edge of the support plate on the downstream side in the ejecting direction positioned above an end edge of the support plate on the upstream side in the ejecting direction, that receives each of the medium ejected through the ejection opening, and that supports the medium in such an orientation that an end edge of the medium on the upstream side in the ejecting direction abuts the stacking surface by pushing an end edge of the medium on the downstream side in the ejecting direction upward along the inclination of the support plate;

a receding mechanism that causes the support member to recede toward the downstream side;

a position maintaining mechanism that maintains a position of the support member having been moved by the receding mechanism;

a transport roller that receives the medium ejected through the ejection opening and that transports the medium toward the downstream side, the transport roller being operatively coupled to an ejection roller of the processing apparatus so that the transport roller is driven by motive power from a rotation shaft of the ejection roller; and a nipping member that, together with the transport roller, nips the medium therebetween so as to transmit a transport force of the transport roller to the medium while the medium is being nipped, wherein the receding mechanism includes an advancing/retreating member provided on a rotation shaft of the transport roller, the advancing/retreating member repeatedly performs, linked with the rotation of the rotation shaft of the transport roller, pushing of the support member and retreating from the support member, the nipping is released when the advancing/retreating member performs the pushing, the nipping member is able to be displaced between a position at which the nipping member together with the transport roller performs the nipping and a position at which the nipping is released, a second cam member is provided on the rotation shaft of the transport roller, and the second cam member causes, linked with the rotation of the rotation shaft of the transport roller, the nipping member to be displaced.

14. The stacker according to claim 13, wherein the position maintaining mechanism includes a pulling mechanism that applies to the support member a pulling force to pull toward the upstream side, and a suppressing mechanism that suppresses the pulling force at a position to which the support member has been caused to recede by a specified distance by the receding mechanism.

15. The stacker according to claim 13, wherein in order to recede the support member, the receding mechanism applies a moving force to move against a frictional force caused by frictional resistance with the stacking surface which serves as a surface sliding against the support member, and the position maintaining mechanism maintains the position of the support member by utilizing the frictional resistance.

16. A stacker adapted to be mounted to a medium ejection tray which stacks medium ejected through an ejection opening of a processing apparatus in a lying orientation, and to cause the medium to be stacked and placed on a stacking surface in a standing orientation, the stacker comprising:

a support member that is movable toward an upstream side and a downstream side in an ejecting direction, that includes a support plate inclined with an end edge of the support plate on the downstream side in the ejecting direction positioned above an end edge of the support plate on the upstream side in the ejecting direction, that receives each of the medium media ejected through the ejection opening, and that supports the medium in such an orientation that an end edge of the medium on the upstream side in the ejecting direction abuts the stacking surface by pushing an end edge of the medium on the downstream side in the ejecting direction upward along the inclination of the support plate;

a receding mechanism that causes the support member to recede toward the downstream side;

a position maintaining mechanism that maintains a position of the support member having been moved by the receding mechanism; and a transport roller that receives the medium ejected through the ejection opening and that transports the medium toward the downstream side, the transport roller being operatively coupled to an ejection roller of the processing apparatus so that the transport roller is driven by motive power from a rotation shaft of the ejection roller, wherein the position maintaining mechanism includes a pulling mechanism that applies to the support member a pulling force to pull toward the upstream side, and a suppressing mechanism that suppresses the pulling force at a position to which the support member has been caused to recede by a specified distance by the receding mechanism, the pulling mechanism is a constant force spring, and the suppressing mechanism is a regulating portion that regulates rotation of the constant force spring in a direction in which the constant force spring is wound.

17. The stacker according to claim 16, wherein the receding mechanism includes an advancing/retreating member provided on a rotation shaft of the transport roller, and the advancing/retreating member repeatedly performs, linked with the rotation of the rotation shaft of the transport roller, pushing of the support member and retreating from the support member.

18. The stacker according to claim 16, wherein the stacker does not include a conveyor belt for transporting the medium.

* * * * *